United States Patent [19]

Sato et al.

[11] Patent Number: 4,505,773

[45] Date of Patent: Mar. 19, 1985

[54] AUTOMATIC LABEL WINDING AND CHARGING DEVICE

[75] Inventors: Yo Sato, Tokyo; Tadao Kashiwaba, Iwate; Yasuhiko Matsuda, Iwate; Tadahisa Oikawa, Iwate, all of Japan

[73] Assignee: Kabushiki Kaisha Sato, Japan

[21] Appl. No.: 585,280

[22] Filed: Mar. 1, 1984

[30] Foreign Application Priority Data

Mar. 3, 1983 [JP] Japan ..... 58-32913

[51] Int. Cl.[3] ..... B65C 9/46; B65C 11/00

[52] U.S. Cl. ..... 156/384; 101/288; 156/577; 156/579; 156/DIG. 47; 156/DIG. 48; 242/67.1 R; 242/68.5; 242/76

[58] Field of Search ..... 156/541, 577, 579, 584, 156/384, DIG. 33, DIG. 47, DIG. 48; 101/288; 242/18 EW, 18 PW, 67.1 R, 68.3, 68.5, 76, 117, 157 R

[56] References Cited

U.S. PATENT DOCUMENTS

| | | | |
|---|---|---|---|
| 3,801,408 | 4/1974 | Kuring et al. | 156/584 |
| 3,944,455 | 3/1976 | French | 156/584 |
| 4,166,588 | 9/1979 | Krehbiel et al. | 242/67.1 R |
| 4,359,939 | 11/1982 | Sato | 101/288 |
| 4,436,573 | 3/1984 | Sato et al. | 156/384 |
| 4,439,257 | 3/1984 | Sato et al. | 156/384 |
| 4,440,592 | 4/1984 | Sato et al. | 156/384 |

*Primary Examiner*—Michael Wityshyn

*Attorney, Agent, or Firm*—Ostrolenk, Faber, Gerb & Soffen

[57] ABSTRACT

An automatic label winding and charging device is part of a system used for printing and applying labels that are temporarily adhered in series to a web of backing paper. The system includes a bar code printer which feeds a printed label web to a cassette and the latter is then insertable into a label applicator so that the printed labels can be dispensed and applied to commodities. The automatic label winding and charging device includes cassette mounting means for mounting the cassette in the printer to receive a printed label web produced by the latter. The printed label web is guided in the printer by guide means disposed adjacent to the cassette mounting means. The cassette is equipped with winding means for winding the printed label web being fed from the printer. Means are included to prevent peeling of printed labels from the printed label web during loading of the cassette.

28 Claims, 48 Drawing Figures

AUTOMATIC LABEL WINDING AND CHARGING DEVICE

BACKGROUND OF THE INVENTION

1. Field of the Invention

The present invention relates to a portable label applying system equipped with a printer, a cassette for receiving a continuous backing paper web with printed labels thereon, and a label applicator adapted to be charged with the cassette having a web of printed labels therein and be manually actuated to peel the labels from their backing paper and apply them to commodities. More particularly, this invention relates to an automatic label winding and charging device for use in the portable label applying system.

2. Description of the Prior Art

The prior art has provided portable type label applicators for peeling printed labels from a web of backing paper and applying them to articles such as commodities. Label applicators of this type are known as "hand labelers" and are widely used in supermarkets for applying labels to the commodities. These applicators are usually used at or near the same counter where the commodities are to be displayed and include printing heads for placing price information on the labels. Recently, bar code labels have come into wide use, but bar codes cannot be printed accurately by the simple type printing head mounted in existing hand labelers so that these bar codes may fail to be read out correctly by an optical reader.

Because bar codes are of standardized size, printing heads therefor are necessarily larger than the usual character printers. As a result, the hand labeler that prints bar codes is large and heavy so that it is not easy to handle and the operator becomes fatigued in a short time. In addition, the bar codes are required to have check digits, but in printing heads for hand labelers it is difficult to include a function that will automatically compute the check digits because of size and other structural considerations. As a result, the check digits have to be computed separately and set in the printing head, thereby making the hand labeler inconvenient in this respect.

Therefore, there has been proposed a system in which a label web having its labels adhered to backing paper web is printed by a desk-type printer and in which the label web having the printed labels is wound upon a cassette, and in which a label applicator is charged with the loaded cassette. This type of system can accurately and efficiently print and apply the bar code labels. However, in prior art systems of this type, the label web has to be manually wound on the cassette and this manual winding operation has proven to be remarkably troublesome.

SUMMARY OF THE INVENTION

Accordingly, the primary object of the present invention is to eliminate the defects of the prior art hereinbefore described.

Another object of the present invention is to provide an automatic label winding and charging device which can automatically wind a web of printed labels upon a cassette that will be used to charge a manually operated label applicator.

According to the present invention, there is provided an automatic label winding and charging device for use in a portable label system that includes a printer for printing a plurality of labels which are adhered in longitudinal series to a web of backing paper, a cassette for taking up the printed label web, and a label applicator adapted to be charged with said cassette for dispensing and applying the printed labels to commodities. Broadly, the automatic label winding and charging device includes cassette mounting means disposed in the printer for mounting said cassette in said printer, guide means disposed adjacent to said cassette mounting means for guiding the label web, and winding means disposed in said cassette for winding the label web being fed from said printer. The printer also includes means in the vicinity of the guide to prevent peeling of labels from their mounting web, and the cassette mounting means includes elements to automatically position and hold the cassette and also to assure that a movable portion of the cassette is appropriately positioned to permit the label carrying web to enter the cassette.

BRIEF DESCRIPTION OF THE DRAWINGS

Other objects, features and advantages of the present invention will become apparent from the following description taken in conjunction with the accompanying drawings, in which:

FIG. 1 is a perspective of a cassette;

FIG. 2 is a perspective of a label applicator;

FIG. 3 is a longitudinally sectional side elevation showing the cassette of FIG. 1 with its rotary member closed;

FIG. 4 is a section taken along line IV—IV of FIG. 3, looking in the direction of arrows IV—IV;

FIG. 5 is a longitudinally sectional side elevation showing the cassette in its mounted state;

FIG. 6 is a top plan view showing the essential portions of a printer;

FIG. 7 is a top plan view showing the cassette mounting mechanism of the printer;

FIG. 8 is a front elevation showing the cassette mounting mechanism of FIG. 7;

FIG. 9 is a side elevation showing the cassette mounting mechanism of FIGS. 7 and 8;

FIG. 10 is a top plan view showing the cassette mounting mechanism in which the cassette is mounted;

FIG. 11 is a front elevation showing the cassette mounting mechanism in its cassette mounting state with selected portions omitted so as to permit clearer viewing of other portions;

FIG. 12 is a side elevation showing the cassette mounting mechanism of FIG. 11 in its cassette mounting state;

FIG. 13 is a rear elevation showing the cassette;

FIG. 14 is a bottom view of the cassette;

FIG. 15 is a longitudinally sectional side elevation showing a label applicator;

FIG. 16 is a top plan view showing the label applicator of FIG. 15;

FIG. 17 is a top plan view showing a continuous web of labels;

FIG. 18 is a longitudinally sectional side elevation showing a label applicator charged with the cassette;

FIG. 19 is an explanatory side elevation showing the label applicator in partial section and charged with the cassette but before a hand lever is actuated;

FIG. 20 is a longitudinally sectional side elevation showing the essential portions of the label applicator with its hand lever partly actuated;

FIG. 21 is a section taken along line XXI—XXI of FIG. 20, looking in the direction of arrows XXI—XXI;

FIG. 22 is a section taken along line XXII—XXII of FIG. 20, looking in the direction of arrows XXII—XXII;

FIG. 23 is a longitudinally sectional side elevation showing the essential portions of the label applicator with the hand lever fully actuated;

FIG. 24 is an explanatory view of the state in which the hand lever is fully actuated; and FIG. 25 is a longitudinally sectional side elevation for explaining how the cassette is removed from the applicator.

FIG. 26 is a longitudinally sectional side elevation showing a cassette according to the second embodiment;

FIG. 27 is a section taken along line XXVII—XXVII of FIG. 26, looking in the direction of arrows XXVII—XXVII; and FIG. 28 is a longitudinally sectional side elevation showing the cassette in its mounted state.

FIG. 36 is a longitudinally sectional side elevation of a cassette;

FIG. 37 is a section taken along line XXXVII—XXXVII of FIG. 36, looking in the direction of arrows XXXVII—XXXVII; and FIG. 38 is a perspective showing a guide member.

FIG. 45 is a longitudinally sectional side elevation showing a cassette having its rotary member closed;

FIG. 46 is a longitudinally sectional side elevation showing key elements at the start of the cassette winding operation;

FIG. 47 is a longitudinally sectional side elevation showing the cassette in the course of the winding operation; and FIG. 48 is a longitudinally sectional side elevation showing the end of the winding operation.

DESCRIPTION OF THE PREFERRED EMBODIMENTS

First Embodiment

Figure 17:
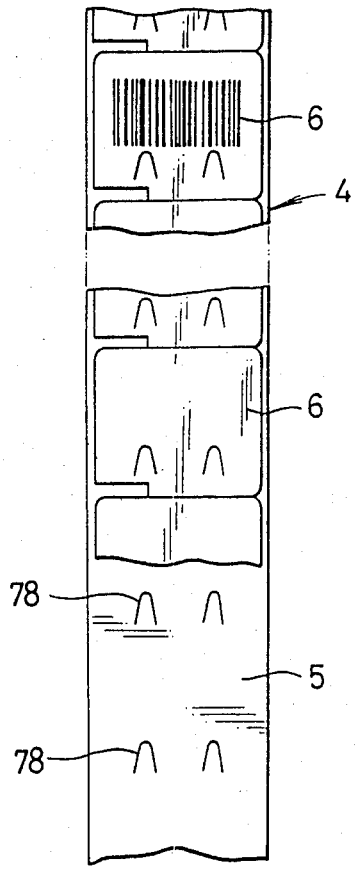

An automatic label winding and charging device according to the present invention forms part of a portable label applying system that includes a printer 3 (FIG. 6) for printing a continuous web of labels 4 (FIG. 17); a take-up cassette 1 (FIG. 1) which is made coactive with the printer 3 for winding the label web 4 having its labels printed by the printer 3; and a label applicator 2 (FIG. 2) which is removably charged with the take-up cassette 1 and adapted to be manually actuated to feed the label web 4 and to peel the printed labels 6 from their backing paper 5 so that the labels 6 may be applied.

Cylindrical take-up core 8 is rotatably mounted in the central portion of frame 7 of take-up cassette 1. This take-up core 8 is comprised of two flanges 8*a* (FIG. 4) which are disposed at opposite ends of core body 8*b* which has a length slightly smaller than the width of the label web 4, and a winding space 8*c* which is so defined by the flanges 8*a* and the core body 8*b* that it is expanded or counter-tapered in the radially outward direction. Moreover, take-up core 8 is formed at its center with hollow boss 11 in which a later-described rotary shaft of printer 3 is to be fitted. In the embodiment shown in FIG. 3, boss 11 is formed to protrude to the outside, as seen from FIG. 4, but it is quite natural to provide an inwardly extending formation in place of boss 11. Indicated by numeral 12 is a rotary member which is rotatably mounted on a pair of annular lands 80 extending inwardly from the main facing walls of cassette frame 7 disposed outboard of the take-up core 8. Rotary member 12 includes generally circular side plates or flanges 10 and protruding curved label holding portion 13 which merges into the two side plates 10. Rotary member 12 is equipped with guide leaf spring 9 that curves partly around the take-up core 8. One end of guide spring 9 is fixed on the outer circumferential edges between flanges 10, 10 at the side opposite label holding portion 13 and the other end of guide spring 9 is curved in an arcuate form to contact the outer circumference of take-up core 8. The position in which guide spring 9 contacts take-up core 8 is located to substantially face the aforementioned label holding portion 13.

Figure 1:
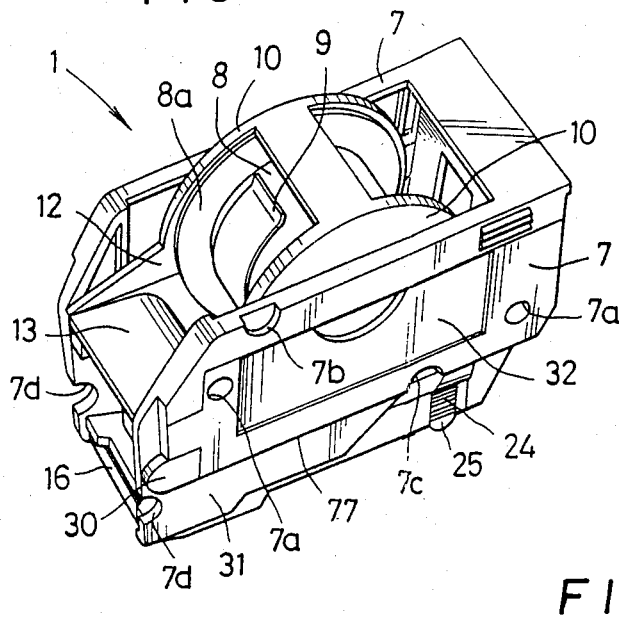
In FIGS. 1 to 25 showing a first embodiment of the present invention.
Figure 3:
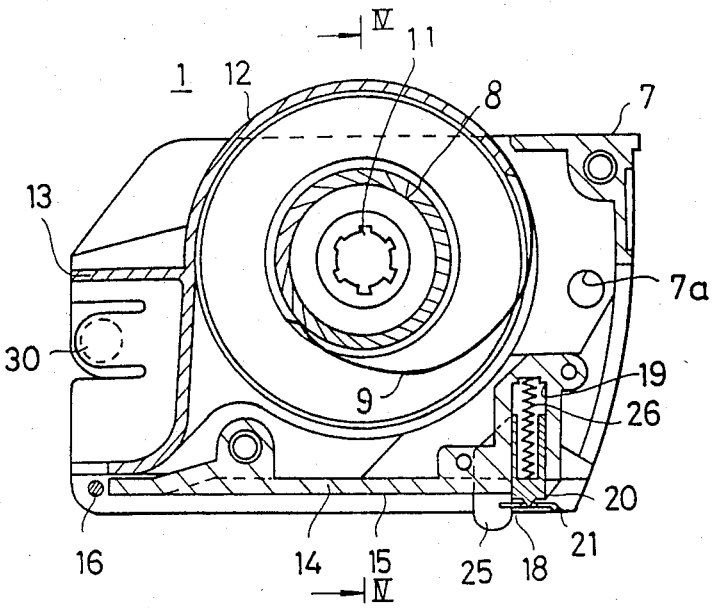
Figure 4:
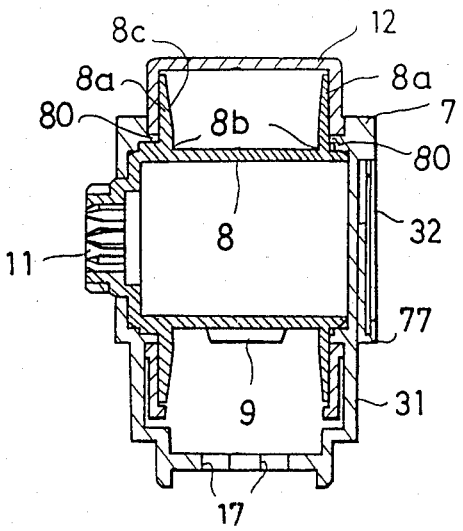
Figure 5:
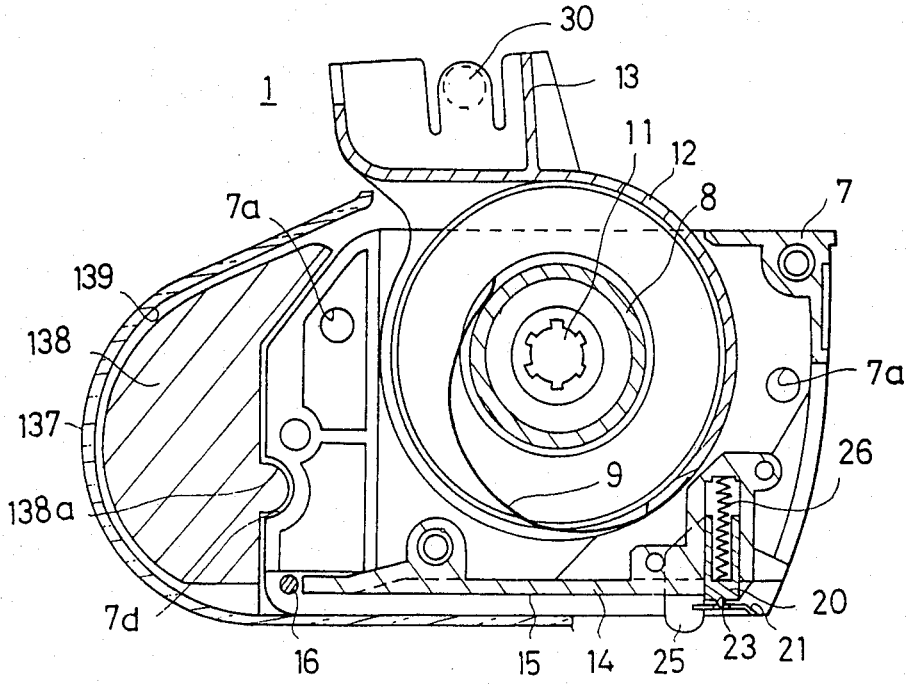
Figure 7:
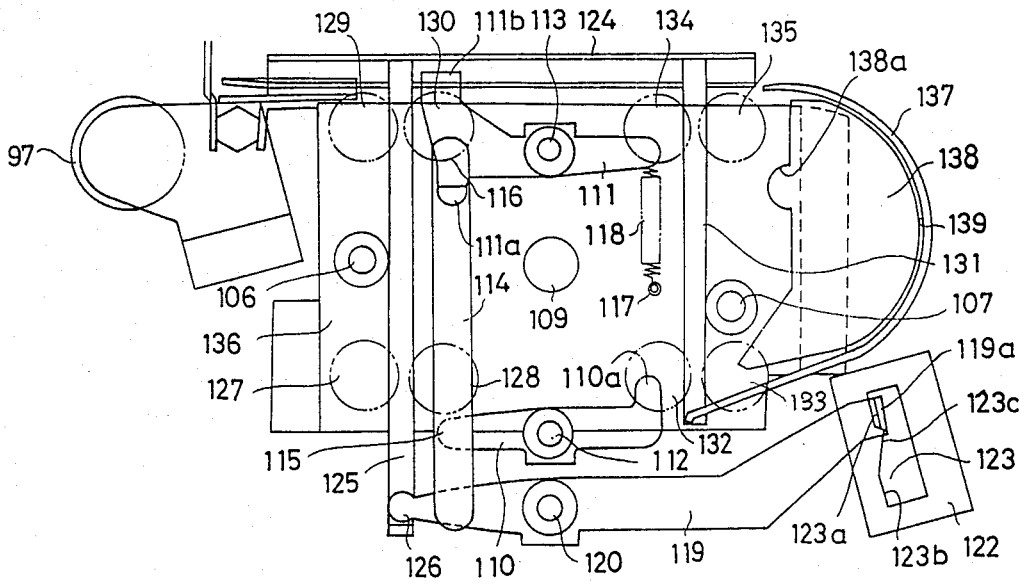
Figure 13:
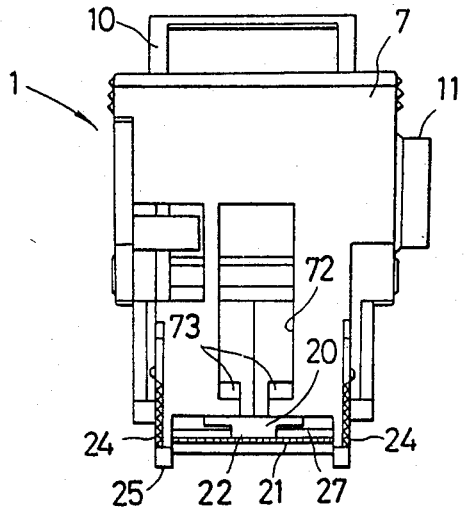
Figure 14:
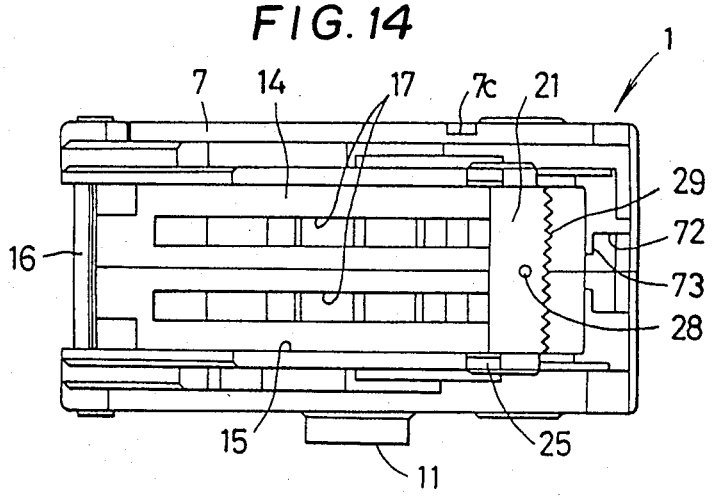

Take-up cassette 1 has its bottom covered with bottom plate 14 which is formed with backing paper guide groove 15 extending longitudinally from the front end to the rear end thereof, as shown in FIG. 3. Bottom plate 14 is also formed with a pair of pawl guides 17 (FIG. 4) extending in the longitudinal direction with respect o plate 14. Indicated by numeral 16 is a turning pin attached to the front of the bottom plate 14 so as to advance backing paper 5. Indicated by numeral 18 is a backing paper holding mechanism which is disposed at the back of the bottom plate 14. Mechanism 18 includes pressure member 20, which is vertically movable in a hole 19 formed in the frame 7, and receiving plate 21 which is fixed on the rear end of the aforementioned backing paper guide goove 15. The lower face of pressure member 20 is formed with pressure land 22 (FIG. 13) which has its lower face at the center thereof proturding to form needle 23 (FIG. 5). The sides of pressure member 20 are formed with integral parallel ribs 24 and the lower portions terminate in semicircular engagement tongues 25 (FIG. 1). Coil spring 26 fitted in hole 19 biases pressure member 20 downward. As a result, engagement tongues 25 usually protrude from the bottom face of take-up cassette 1, and pressure land 22 abuts the upper face of the receiving plate 21. Attachment of receiving plate 21 to bottom plate 14 provides a gap 27 (FIG. 13) of sufficient thickness to allow passage of backing paper 5 therethrough. The central region of receiving plate 21 is provided with through hole 28 (FIG. 14) for receiving needle 23 of pressure member 20 and the rear edge of plate 21 is serrated to form backing paper cutter 29.

Turning to FIG. 1, the front edges at both sides of take-up cassette 1 are formed with semicircular engagement projections 30 and both sides are slightly recessed at their lower portions to form mounting portions 31 at which take-up cassette 1 is to be mounted in printer 3 or the label applicator 2. Reference numeral 32 indicates a display label fitting recess in the side of cassette 1. Both side plates of cassette 1 are formed with cassette positioning holes 7*a*, in which positioning pins, to be described hereinafter, of printer 3 are to be fitted. The side plates of the cassette 1 are formed at their upper and lower ends with respective recesses 7*b* and 7*c* adapted to receive positioning levers, to be hereinafter described, of printer 3. Moreover, the leading end of cassette 1 at its side edges is provided with notches 7*d* for preventing cassette 1 from being inserted erroneously in printer 3 with rotary member 12 being left unraised.

Figure 2:
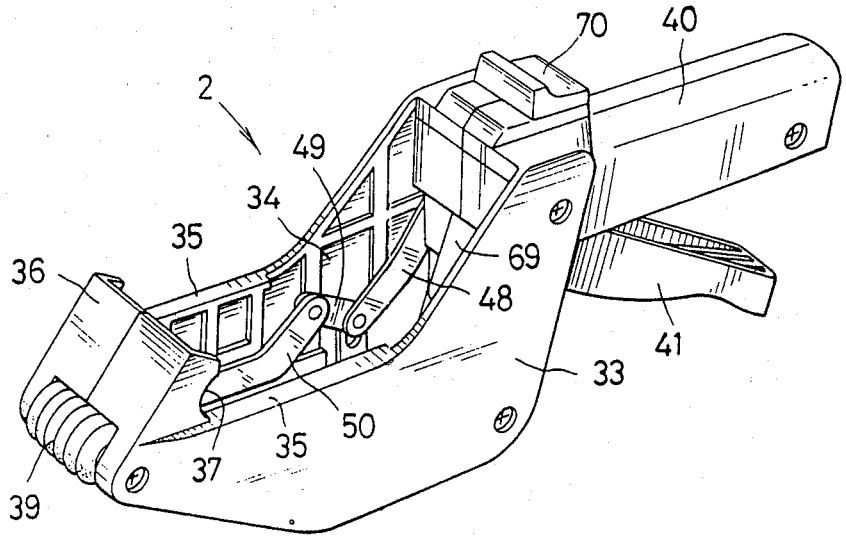
Figure 15:
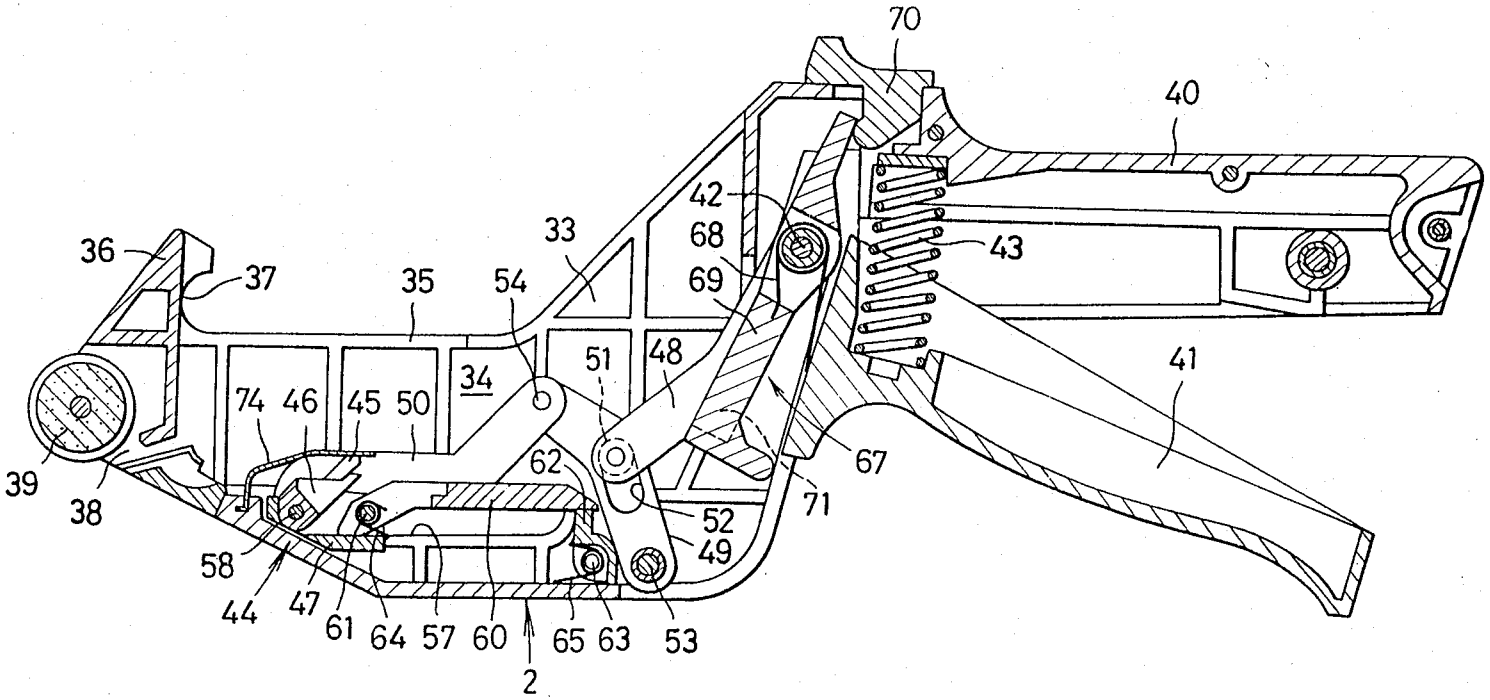
Figure 16:
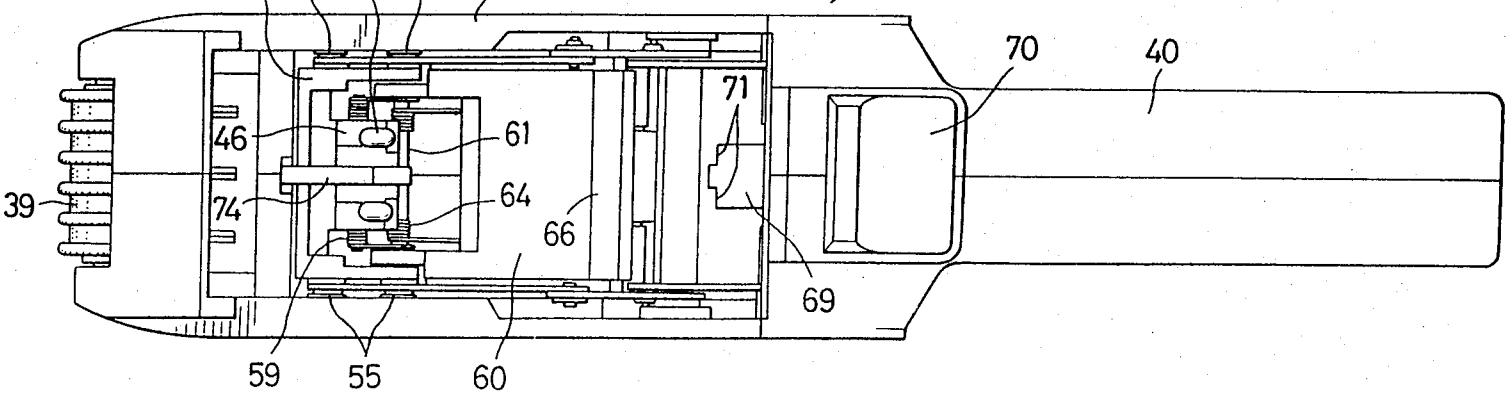

Turning now to FIGS. 2, 15 and 16 which illustrate label applicator 2, frame 33 of applicator 2 defines space 34 for accommodating the lower portion of take-up cassette 1. The upper flat edges of frame 33 extend slightly inwardly to provide ledges 35. Formed inside of front wall 36 of the frame 33 are a pair of generally semicircular engagement notches 37. In the front end of frame 33, moreover, there is a rotatably mounted label applying roller 39, below which is formed label exit 38 (FIG. 15). Applicator frame 33 includes a rearward extension that constitutes grip 40, below which hand lever 41 is disposed. The front end of lever 41 is hinged at pin 42 to the frame 33. Between hand lever 41 and grip 40 is return spring 43 which biases hand lever 41 clockwise, as shown in FIG. 15.

Disposed in the lower portion of frame 33 is feed mechanism 44 for feeding or advancing the backing paper 5. Mechanism 44 is constructed of pawl member 46 which has its upper end formed with a pair of advancing pawls 45; holding frame 47 supporting pawl member 46; and first, second and third links 48, 49 and 50 for moving holding frame 47 back and forth. One end of first link 48 is fixed to hand lever 41, and roller 51 attached to the other end of link 48 is fitted in slot 52 which is formed in the central region of second link 49. Link 49 has its lower end hingedly connected to pin 53 which extends across frame 33, and the upper end of link 49 is connected to one end of third link 50 at hinge 54. The other or leading end of link 50 is fixed to holding frame 47.

As seen in the plan view of FIG. 16, holding frame 47 is generally U-shaped. Two rollers 55 and 56 are attached to each side of holding frame 47. Rollers 55, 56 are fitted in guide grooves 57 formed in the inner walls of frame 33. Pawl member 46 is rotatable on pin 58 which extends across holding frame 47 and is biased counterclockwise with respect to FIG. 15 by the action of torsion spring 59. Push-up plate 60 is hinged to holding frame 47 by means of pin 61 mounted across the rear of frame 47. Supporting member 62 is mounted on pin 63 that extends across frame 33. Through the actions of torsion springs 64 and 65, respectively, push-up plate 60 and the supporting member 62 are biased counterclockwise and clockwise, respectively, as viewed in FIG. 15. In the still state of FIG. 18, the upper face of supporting member 62 abuts and thereby supports the lower face at the rear end of push-up plate 60.

Push-up plate 60 is formed with a downward and rearward sloping portion 66 at the upper face of its rear end. Lock mechanism 67 (FIG. 15), for locking the take-up cassette 1 to be charged in printer 3, is disposed at the back of frame 33 and is constructed of lock member 69 hinged to frame 33 on pin 42 and biased in the clockwise direction by the action of torsion spring 68, and dismounting button 70 that abuts lock member 69 and is mounted to slide back and forth at the upper rear portion of frame 33. When label applicator 2 is to be charged with cassette 1, the lower end corner 71 of lock member 69 comes into engagement with engagement projections 73 at the lower end of the opening 72 formed in the rear face of cassette 1 so that cassette 1 is locked (as seen from FIGS. 13, 16 and 18). Positioned in front of the pawl member 46 and attached to frame 33 is backing paper holding member 74 formed of leaf spring material.

Figure 6:
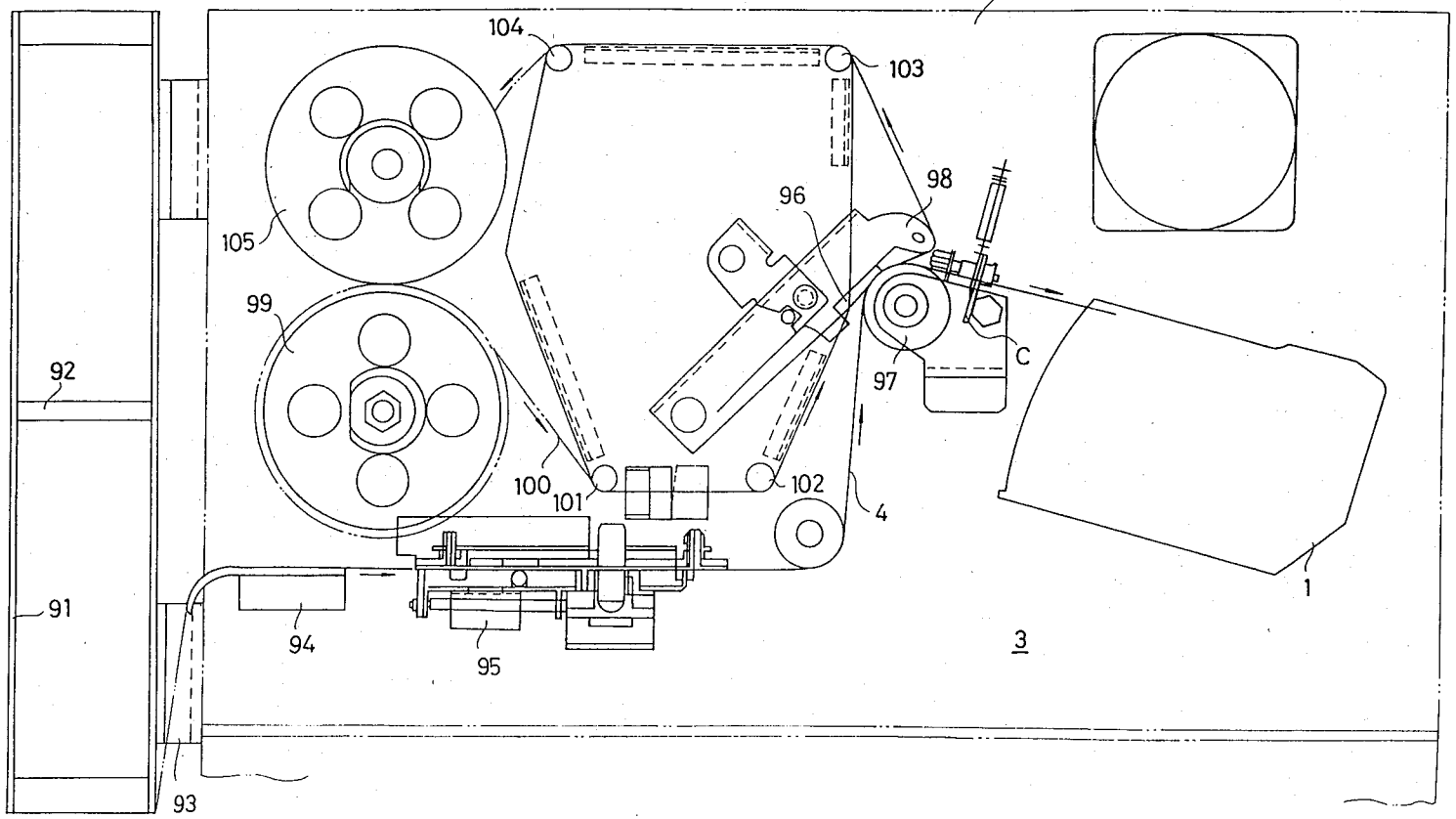
Figure 8:
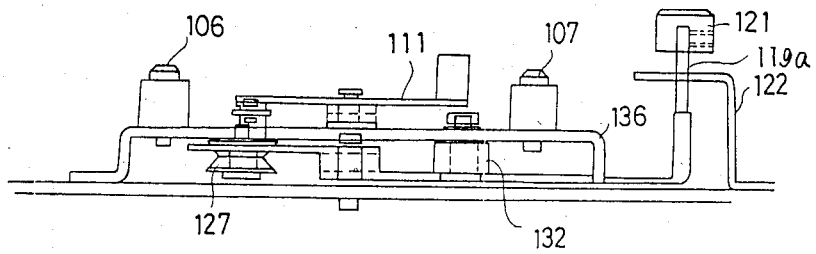
Figure 9:
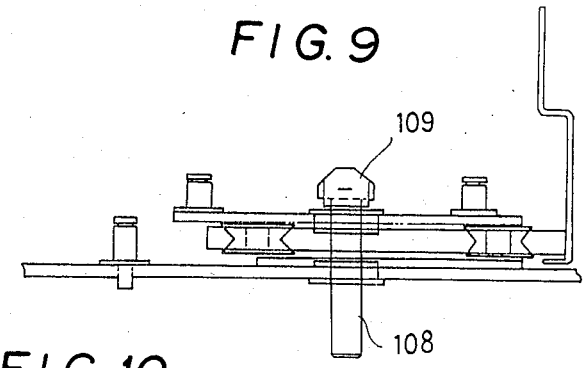

In FIG. 6, the well-known portions of printer 3, such as a keyboard and a display, are omitted, but the printing unit and the winding unit are shown in a top plan view. In particular, at one side of base frame 90, i.e. at the left-hand side of the drawing, reel 91, wound with continous label web 4 having its labels 6 unprinted, is removably and rotatably mounted on holding shaft 92. Label web 4 being unwound from reel 91 is twisted at a right angle through guides 93 and 94 so that it is in an upright position with respect to base frame 90 when it is guided thereabove. Having passed over the guide 94, web 4 advances through position detecting mechanism 95 where the position of label 6 is detected by detecting means such as a photo-sensor. Downstream of mechanism 95 web 4 advances between thermal head 96 of the heat transfer type and a platen 97, which cooperate to act as a thermal printer. Thermal head 96 is attached to a side of pivoted arm 98 near the free end thereof and is urged toward platen 97 by the action of a spring (not shown).

Reference numeral 99 indicates a supply or let-off reel on which a heat tranfer ink ribbon 100 is wound. Downstream of reel 99, ink ribbon 100 is guided around guide rollers 101 and 102 to thermal head 96 where ribbon 100 is superposed upon label web 4 before printing so that predetermined bar codes are transferred onto labels 6 by the action of the thermal head 96. After this transfer, ink ribbon 100 is guided by guide pins 103 and 104 to take-up reel 105 which is arranged in juxtaposition to the let-off reel 99. At the same time, label web 4 having its labels 6 bearing the transferred bar codes is turned at the platen 97 until it is guided into cassette 1 which is removably mounted on the base frame 90.

The mechanism for mounting cassette 1 to frame 90 will be described in detail with particular reference to FIGS. 6 to 12. Anchored to base frame 90 in the vicinity of the platen 97 are two upwardly protruding guide pins 106 and 107 that are fitted into holes *7a* of cassette 1 to position the latter. Head 109 of a rotary shaft 108 is disposed generally midway between guide pins 106 and 107, with head 109 being fitted in boss 11 of cassette take-up core 8. Arranged across head 109 is a group of lock levers 110 and 111 which are rotatably mounted on pins 112 and 113, respectively. Pin 115 connects one end of lock lever 110 to a link 114 and the other end 110*a* of lever 110 is formed into a bent portion that is to be fitted in recess *7b* formed in the side plate of cassette 1 in the vicinity of the upper end edge thereof. The other lock lever 111 is hingedly connected at one end to link 114 by means of pin 116. Bent portion 111*a* of lock lever 111, located in the vicinity of connecting pin 116, is to be fitted in recess *7c* formed in the lower portion of the side plate of cassette 1. On the other hand, bent portion 111*b* of lock lever 111 extends upward at the side of lever 111 opposite to the bent portion 111*a*. Portion 111*b* is positioned to contact and press the leading end of engagement tongue 25 of cassette 1. Tension spring 118 is connected between the other end of lock lever 111 and pin 117 anchored to base frame 90 in a position close to lock lever 110, and biases lock lever 111 to turn clockwise of FIG. 7. Outboard of lock lever 110 is actuating lever 119 which has its intermediate portion rotatably mounted on pin 120. Actuating lever 119 has one end 119*a* bent upward to form a tab on which knob 121 is mounted. Upward bent portion 119*a* has its intermediate portion fitted in cam hole 123 of locking member 122. One side edge defining cam hole 123 includes stepped cam portion 123*a* for regulating the lock position and a stepped cam portion 123*b* for regulating the release position. Cam portions 123*a* and 123*b* are joined through a sloped portion 123*c*.

Figure 12:
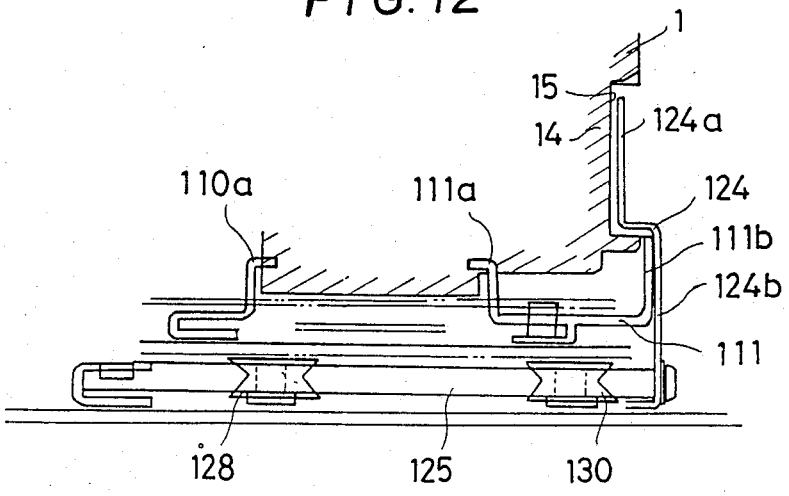

Label guide 124 is positioned outboard of lock lever 111 and, as shown in FIG. 12, is formed by bending the intermediate portion of a metal plate to form a step. The upper end portion 124*a* of guide 124 is fitted in backing paper guide groove 15 so that a slight gap is provided between end portion 124*a* and bottom plate 14 to permit continuous label web 4 to pass therethrough. The lower end of label guide 124 extends outside of bent portion 111*b* of the lock lever 111 and outboard of the lower side of the lock lever 111.

Connecting bar 125 extends between link 114 and the guide pin 106, and is generally parallel to the former. One end of connecting bar 125 is hingedly connected through ball joint 126 to the end portion of actuating lever 119 opposite to knob 121 and the other end of connecting bar 125 is fixed to one side of the label guide 124. Two pairs of rollers 127, 128, 129 and 130 guide connecting bar 124 for linear motion. Guide bar 131, having one end fixed to label guide 124, is arranged parallel to connecting bar 125 and is disposed outboard of the ends of lock levers 110, 111 remote from bar 125. Guide rollers 132, 133, 134 and 135 restrict guide bar 131 to linear motion. Guide rollers 127 through 130 and 132 through 135 are attached to bracket 136 that is secured to base frame 90. Typically, guide rollers 127 through 130 and 132 through 135 are grooved but may be of other forms known to the art. The free end of arcuate guide member 137 is disposed at the leading end of label guide 124 in frame 7 of cassette 1 while the other end of guide member 137 is fixed to either base frame 90 or bracket 136. Peel preventing member 138 is disposed inside the curve of guide member 137 and is constituted by a block having its side edge curved to profile the guide member 137 to define arcuate guide groove 139 therebetween. Preferably guide member 137 and/or peel preventing member 138 are removable in order to facilitate cleaning guide groove 139 or to prevent the same from being jammed with labels 6. The side edge of the peel preventing member 138 remote from the arcuate edge thereof is shaped to complement the edge of the leading end of cassette 1 and is formed near its mid-region with a projection 138*a* which is to be fitted in notches *7d* formed in the leading end of cassette 1. Peel preventing member 138 is highly curved to prevent labels 6 from being peeled off their backing paper 4 as the label web is guided in an arcuately bent shape.

Operation of the automatic label winding and charging device having the construction thus far described will now be described. That is, initially an empty cassette 1 is set on the frame 90 of the printer 3 by making use of the lock levers 110 and 111. At this time, rotary member 12 of the cassette 1 is turned clockwise with respect to FIG. 1 to its open position. In this state actuating lever 119 is turned clockwise with respect to FIG. 7 around the pin 120, by manually pinching the knob 121, to move bent portion 119*a* of lever 119 from cam portion 123*b* of locking member 122. Thereafter, link 114 and connecting bar 125 are pushed upward with respect to FIG. 7 to push label guide 124 and to turn lock levers 110 and 111 clockwise around pins 112 and 113, respectively. As a result, bent portion 110*a* of lock lever 110 and bent portion 111*b* of lock lever 111 are turned away from head 109 of rotary shaft 108. At this stage, cassette 1 can be mounted on bracket 136 above base frame 90.

Figure 10:
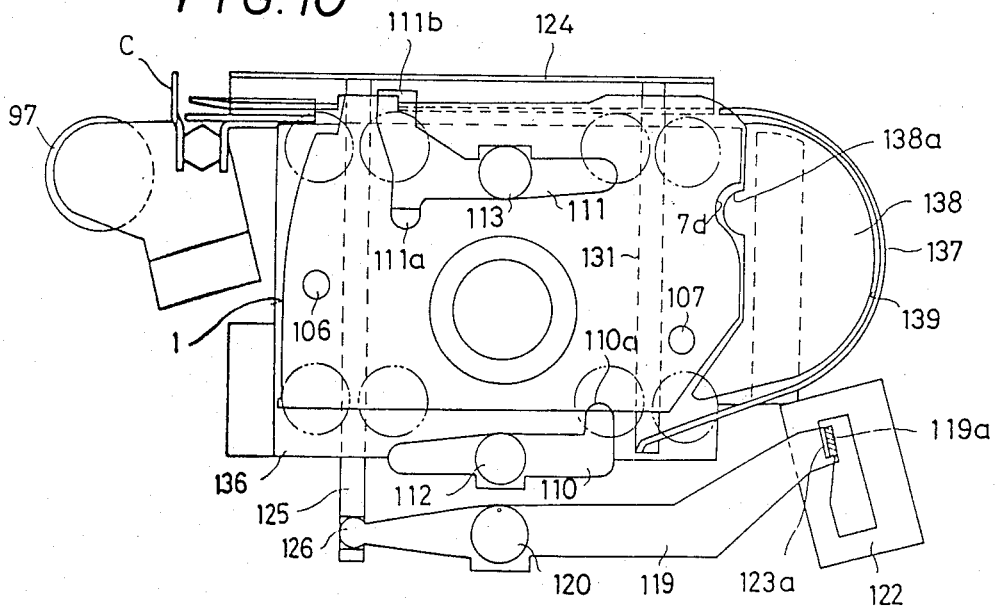
Figure 11:
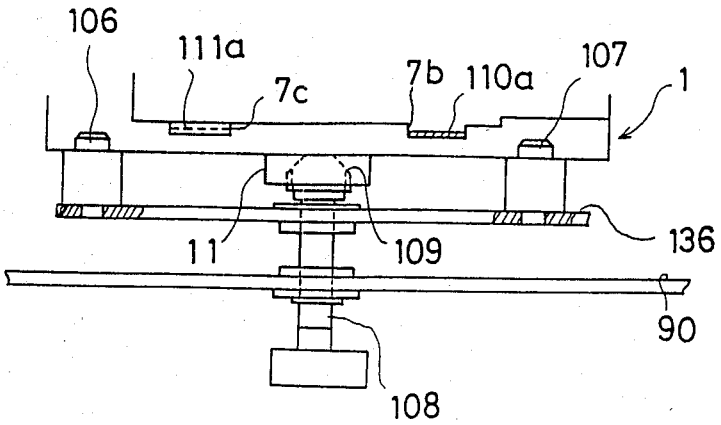

After this setting operation, cassette 1 is brought onto bracket 136 with open rotary member 12 being positioned at the side of actuating lever 119 and with backing paper guide groove 15 being directed toward label guide 124. Guide pins 106 and 107 are fitted in positioning holes *7a* of the cassette 1. In this state, as shown in FIG. 10, projection 138*a* of peel preventing member 138 is fitted in notches *7d* formed in the side edges at the leading end of the cassette 1. If, at this time, cassette 1 should be set erroneously with rotary member 12 being left unopened, this setting is detected immediately because rotary member 12 has its label holding portion 13 closing or blocking notches *7d*. In the state, with cassette 1 mounted on guide pins 106 and 107, bent portions 110*a* and 111*a* of lock levers 110 and 111 are positioned apart from recesses *7c* and *7d* of cassette 1 so that they do not provide obstruction to the mounting operation of the cassette 1.

After this, actuating lever 119 is turned counterclockwise around pin 120 to have its bent portion 119*a* fitted on stepped cam portion 123*a*. Then link 114 and connecting lever 125 are pulled downwardly with respect to FIG. 10 so that label guide 124 is pulled toward cassette 1, whereas lock levers 110 and 111 are turned counterclockwise. As a result, upper end portion 124*a* of label guide 124 enters backing paper guide groove 15 of cassette 1 (FIG. 12) to leave a gap along bottom plate 14 to guide continuous label web 4. By turning lock lever 110 counterclockwise, bent portion 110*a* enters notches *7d* of cassette 1. Likewise, bent portion 111*a* enters recess *7c* of cassette 1 through the counterclockwise turning of lock lever 111. At the same time, engagement tongues 25 at the lower end of the knob 24 are pushed by bent portion 111*b*, located at the outer side of lock lever 111, so that pressure member 20 moves against the biasing force of spring 26 to disengage needle 23 from backing paper guide groove 15. As a result, there is nothing to obstruct the passage of continuous label web 4 between label guide 124 and bottom plate 14 of cassette 1. Thus, cassette 1 is reliably locked in operating position by the lock levers 110 and 111.

After cassette 1 has been mounted in the predetermined position, the keyboard (not shown) of printer 3 is used to input the air codes which are desired to be printed. Continuous label web 4 having labels that have not been printed on its pulled out of reel 91 along guides 93 and 94, through position detecting mechanism 95 acting as another label guide, and is turned along platen 97 until its leading end is guided into the gap between label guide 124 and bottom plate 14 of cassette 1. At this time, heat transfer ink ribbon 100 is also pulled from reel 99 and is guided along guide rollers 101 and 102 and between thermal head 96 and label web 4 until the leading end of ink ribbon 100 is taken up by the take-up reel 105 through guide rollers 103 and 104. In this condition, when the start button (not shown) is depressed, a motor (not shown) is energized to turn rotary shaft 108 so that head 109 thereof fitted in boss 11 of cassette 1 causes take-up core 8 to rotate. At the same time platen 97, takeup reel 105, etc. rotate so that thermal head 96 is operated to print bar codes in response to preset printing instructions. Continuous label web 4 having bar codes heat-transferred to its labels 6 is advanced continuously or consecutively intermittently through the label guide 124. After leaving label guide 124 web 4 advances along guide member 137 to cassette 1 by way of guide groove 139 extending between guide member 137 and peel preventing member 138. At this time rotary member 12 of cassette 1 is opened (FIG. 5) and label web 4 is guided along the lower side of label holding portion 13 into winding space 8*c* defined by rotary member 12 and take-up core 8. Since winding space 8*c* is counter-tapered by the inner faces of flanges 8*a* and 8*a* of the take-up core 8, label web 4 is guided for a while between flanges 8*a* and 8*a* without being dragged by their inner faces. Before long, label web 4 is guided along guide spring 9 to take-up core 8 until it is thrust onto take-up core 8 by the leading end of guide plate 9. At this time, both side edges of label web 4 are in contact with straight core body 8*b* at the legs of flanges 8*a* and 8*a*. Since straight core body 8*b* has a width slightly smaller than that of label web 4, the latter has both its side edges restricted when it is pushed onto take-up core 8 by guide spring 9, so that it is wound or taken up sequentially as the take-up core 8 is turned. When the take-up of the continuous label web 4 reaches a predetermined quantity, the motor (not shown) is stopped to interrupt the supply or let-off of the label web 4. After that, cutter C interposed between platen 97 and label guide 124 may be operated to cut label web 4.

The cassette 1 with a predetermined quantity of label web 4 having the bar codes printed is then dismounted from the printer. For this cassette dismounting operation, actuating lever 119 is turned clockwise, as viewed in FIG. 10, to unlock cassette 1 from lock levers 110 and 111, and label guide 124 is disengaged from cassette bottom plate 14 to release cassette 1 from any restriction. Then, cassette 1 can be easily removed by manual disengagement from guide pins 106 and 107. Two or three sheets of labels 6 are peeled from the bottom plate 14 of the removed cassette 1, and rotary member 12 is returned to the locked state of FIG. 1, thereby finishing the charging operation of cassette 1 with labels 6.

Figure 18:
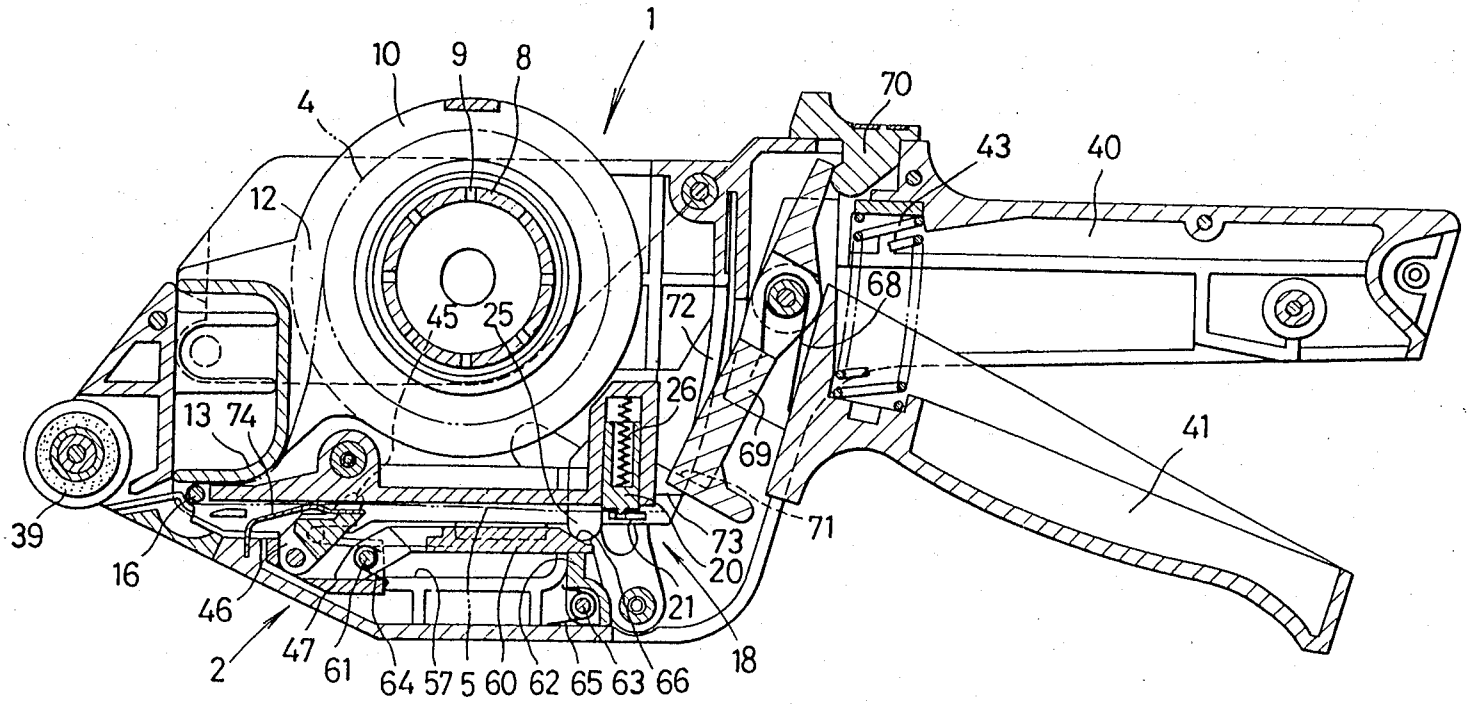
Figure 19:
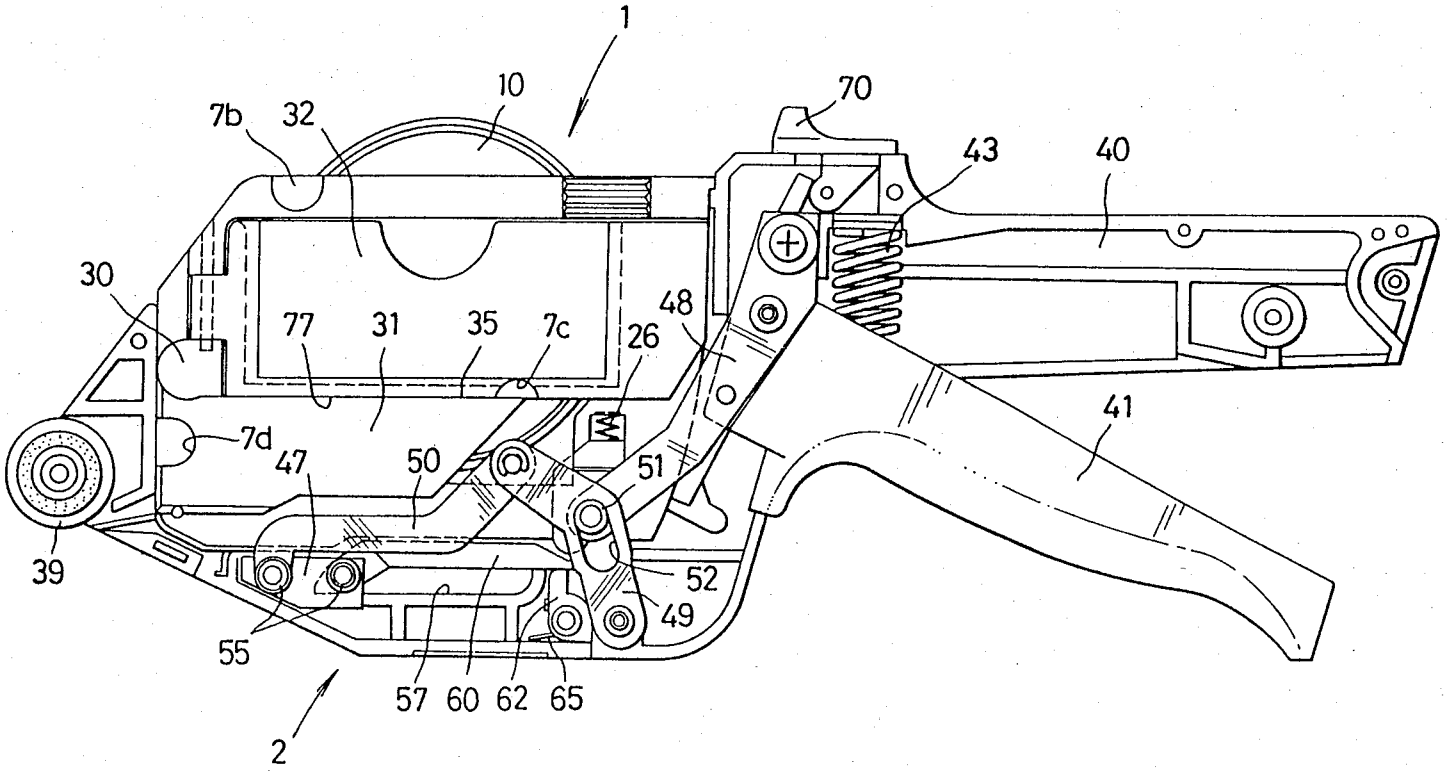
Figure 20:
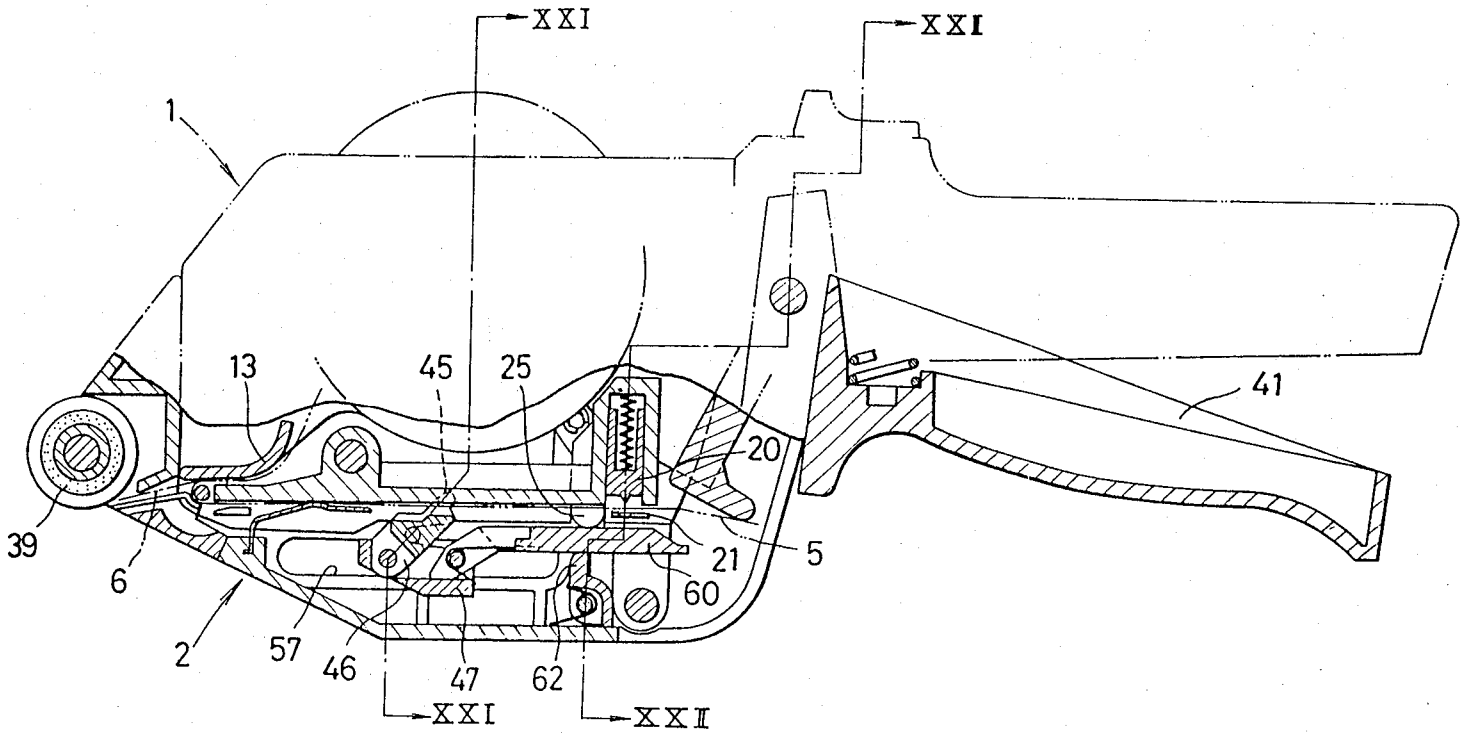
Figure 21:
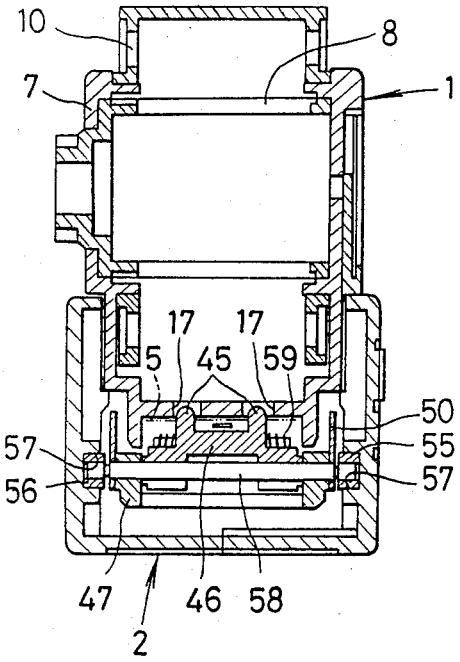
Figure 22:
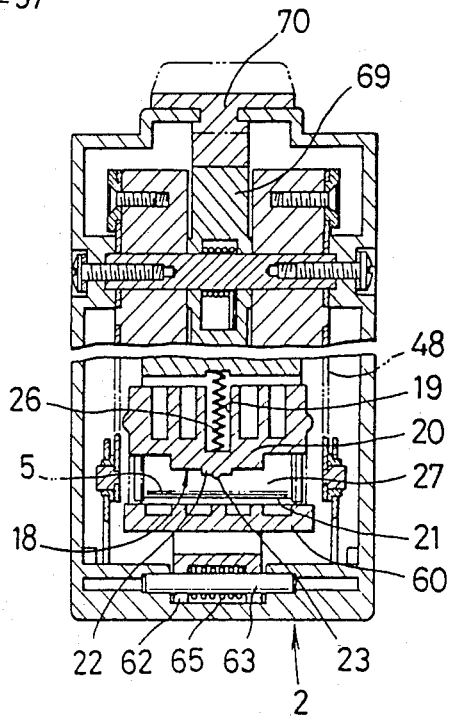
Figure 25:
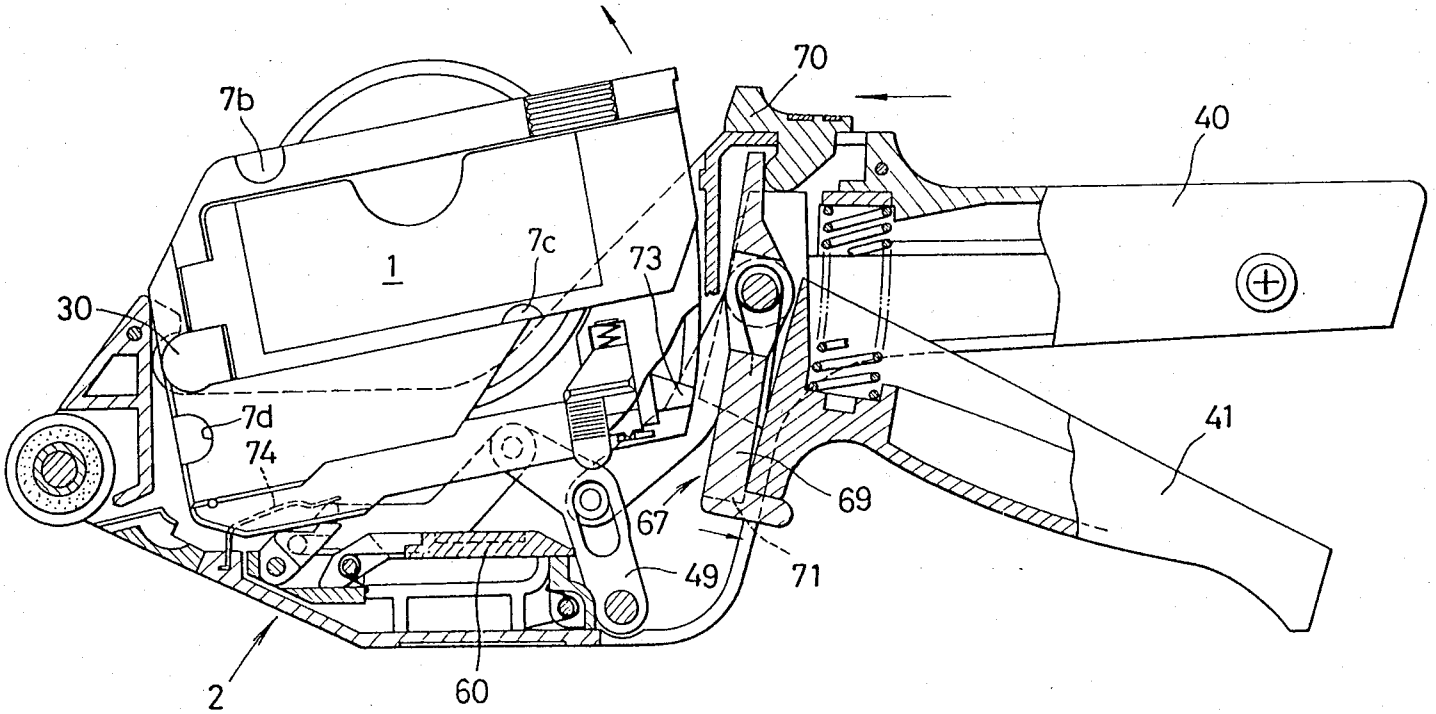

Cassette 1 charged with printed labels is then attached to label applicator 2 by inserting mounting portions 31 of cassette 1 into accommodating space 34 of applicator 2 with engagement projections 30 at the leading end of cassette 1 being held in engagement with engagement notches 37 of the applicator 2. At this time, shoulders 77, which are formed below the display label fitting recesses 32 of cassette 1, are placed on ledges 35 of applicator 2 so that cassette 1 engages and is automatically locked by mechanism 67 (FIG. 25). When cassette 1 is to be inserted, more specifically, engagement projections 73 (FIG. 25) move down, thereby turning lock member 69 counterclockwise against the biasing force of the spring 68. When engagement projections 73 move below lower end corner 71 of lock member 69, the latter is returned to its original position through the action of spring 68 so that its lower end corner 71 comes into locking engagement with engagement projections 73 (FIG. 18).

Figure 24:
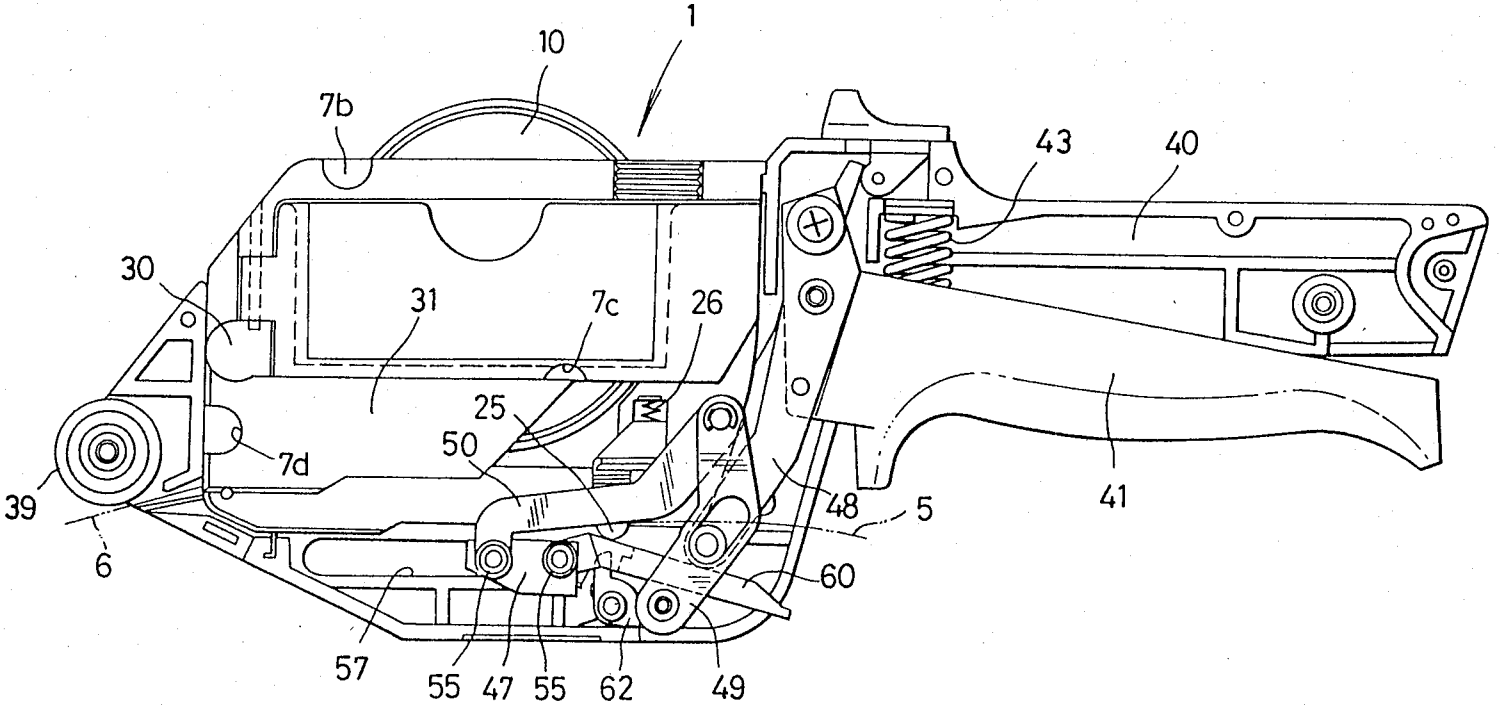

If hand lever 41 is then squeezed, through the action of first, second and third links 48, 49 and 50, holding frame 47 is moved horizontally back along guide grooves 57. During this horizontal movement of frame 47, advancing pawls 45 of pawl member 46 engage with cuts 78, formed at predetermined intervals in the backing paper 5 (FIG. 17) to advance backing paper 5. Push-up plate 60 is also moved to push engagement tongues 25 of pressure member 20. As a result, backing paper 5 is released from being held by pressure land 22 and needle 23 of pressure member 20 so that backing paper 5 is fed rearward smoothly until being discharged to the outside of the label applicator 2. If hand lever 41 is squeezed further (FIG. 24), push-up plate 60 is retracted to disengage its lower face from the supporting member 62. As a result, pressure member 20 under the force of spring 26 moves down to its original position while pushing push-up plate 60 counterclockwise, so that backing paper 5 is held again by the coactions of pressure land 22 and the needle 23. During this backing paper feeding operation, since the label web 4 has its advancing position regulated to a horizontal position, only the backing paper 5 is turned at an acute angle by turning pin 16 (FIG. 18) at the front end of cassette 1 so that labels 6 are peeled from backing paper 5 and allowed to advance until they are fed through label exit 38 down to the label applying roller 39.

Figure 23:
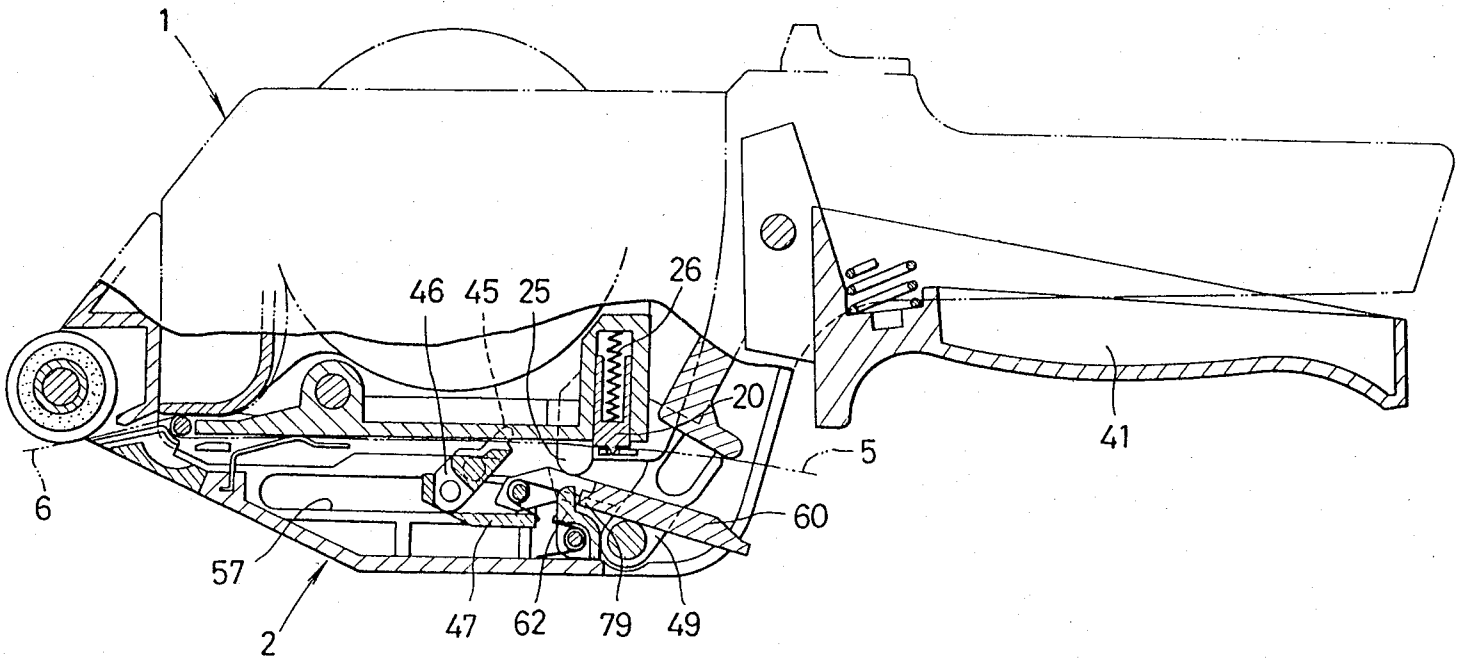

Applications of peeled labels 6 to commodities is conducted by the actions of the roller 39, as in many hand labelers, as the lower (or adhesive) side of the label 6 just below the applying roller 39 is applied to and rubbed on a commodity. If hand lever 41 is then released, it is returned to its original position by the action of the return spring 43, and holding frame 47 is returned forward to the position of FIG. 18 through the first to third links 48 to 50. During this forward movement of frame 47, lower face corner 79 (FIG. 23) of push-up plate 60 abuts supporting member 62 to turn the same counterclockwise because the force of spring 26 urging push-up plate 60 down is stronger than the summation of the forces of springs 64 and 65. Thus, as push-up plate 60 advances, it slides on the lower faces of tongues 25 without raising the same. As a result, backing paper 5 is fixed by the pressure member 20 and is not returned to the front by the forward motion of the pawl member 46.

As pawl member 46 advances, pawls 45 thereof disengage from cuts 78 of backing paper 5 and member 46 turns clockwise against the action of spring 59 to slide on the lower side of the backing paper 5 until member 46 is restored to its original forward position, and pawls 45 fall into cuts 78 of backing paper 5.

In order to dismount take-up cassette 1 from label applicator 2, dismounting button 70 is pushed forward to its position shown in FIG. 25. This pivots lock member 69 counterclockwise to disengage its lower end corner 71 from engagement projections 73 of cassette 1. This permits the rear portion of cassette 1 to spring upward slightly due to the biasing action of backing paper holding member 74, so that cassette 1 can be removed easily by hand. Holding member 74 normally engages the lower side of backing paper 5 at the portion thereof in the front section of backing paper guide groove 15.

Thus, it is seen that in the embodiment of FIGS. 1–25 that has been described, a predetermined length of label web 5 having its labels 6 printed with the bar codes can be wound automatically on cassette 4 by charging printer 3 with cassette 1. Moreover, mounting of cassette 1 in printer 3 can be conducted by the single action of operating actuating lever 119. Labels 6 are not peeled from web 4 while it is being loaded into cassette 1 because printer 3 is equipped with peel preventing member 138. Since take-up core 8 of cassette 1 is formed integrally with flanges **8*a* and 8*a* that rotate with the core 8, there is no relative velocity between continuous label web 5 and flanges 8*a*. As a result, any adhesive that may reach the side edges of label web 4 is neither rubbed by nor left on flanges 8*a*, so that the winding and rewinding operations of label web 4 are performed remarkably smoothly. If a small amount of adhesive is left on straight core body 8*b*, this adhesive establishes slight adhesion of label web 4 being wound, thereby providing the beneficial effect of holding label web 4** at the initial stage of the winding operation.

Second Embodiment

Figure 26:
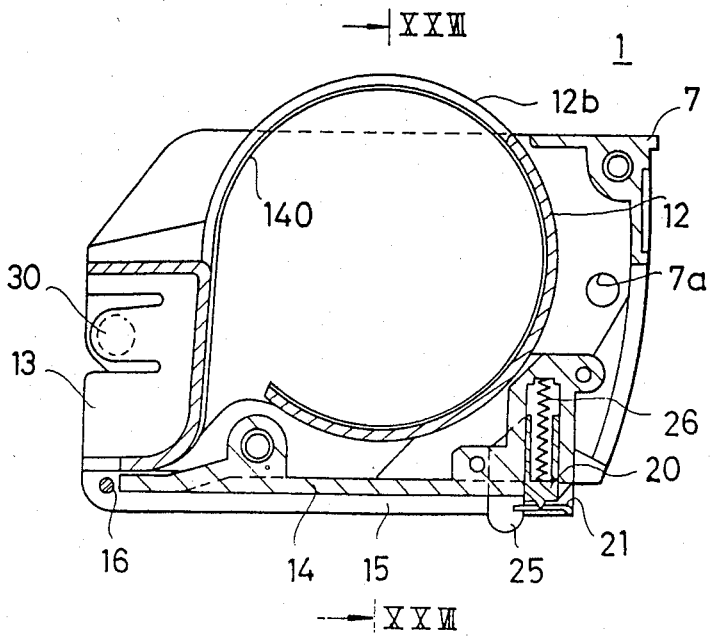
In FIGS. 26 to 28 showing a second embodiment of the present invention.
Figure 27:
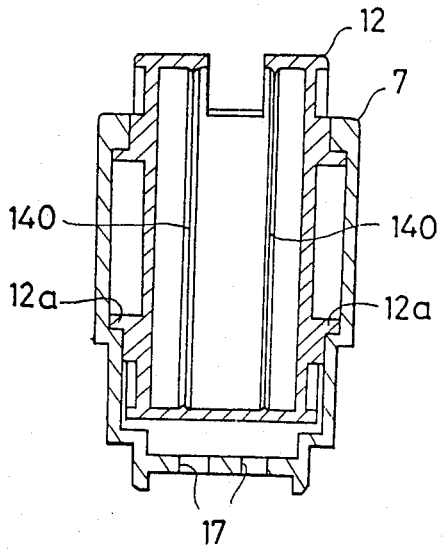
Figure 28:
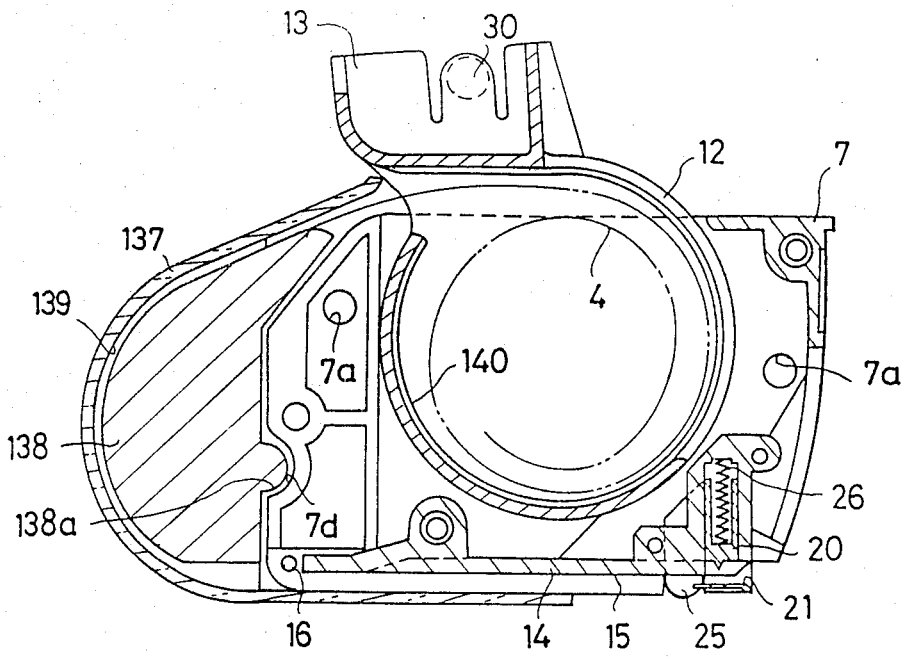

FIGS. 26 through 28 illutrate another embodiment of the present invention in which a take-up core is omitted, only rotary member 12 being mounted in cassette 1. Rotary member 12 is formed as a hollow frame that is pivotally mounted on a cylindrical lands **12*a* (FIG. 27) in the sidewalls of cassette frame 7. To reduce drag while web 4 is being loaded, the inner circumference of rotary member 12 is formed with two parallel ridges 140, of triangular cross-section, which extend along the entire circumference from the back of the label holding portion 13. For a reason that will hereinafter be seen, member 12 is also provided with slit 12*b* which extends from the rear of label holding portion 13 to the circumferentially central portion of rotary member 12. The only take-up means in this second embodiment is rotary member 12**.

To load the cassette of FIGS. 26–29, label web 4 is wound or taken up by being passed through the guide groove 139 (FIG. 28) and then advanced from the opening of the raised rotary member 12 to the inside of rotary member 12. Label web 4 advances along the inner circumference of rotary member 12, while contacting with the ridges 140, until it is curled in an arcuate shape. The advancing force of label web 4 is generated by the rotating force of platen 97. As a result, label web 4 is gradually wound in a spiral in accordance with its own rigidity and elasticity. A limiting feature of this is that as the number of turns increases, the frictional forces between the wound layers may exceed the strength afforded by the rigidity of the label web 4. Despite this fact, the label web 4 can be wound or taken up automatically satisfactorily so long as the printer is equipped with peel preventing member 138 and guide member 137.

To prevent dust from reaching the inside of rotary member 12 through the slit **12*b*, transparent cover 142 (FIG. 29) is provided. Pin 141 pivotally connects cover 142 to rotary member 12 in the vicinity of label holding portion 13. Cover 142 is arcuate and can be fitted in slit 12*b*. Hooking portion 142*a* at the free end of cover 142 can be hooked by engagement portion 142*b* on rotary member 12. Ridges 140 are formed on the inner circumference of the cover 142. By opening cover 142, access to the inside of rotary member 12 is facilitated to enable troubles related to label web 4 in rotary member 12** to be remedied.

Third Embodiment

Figure 29:
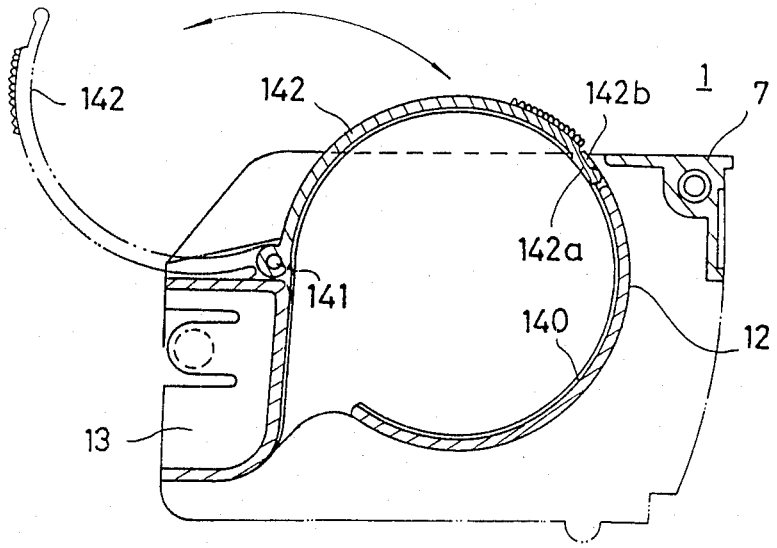
FIG. 29 is an explanatory view showing a modification of the second embodiment.
Figure 30:
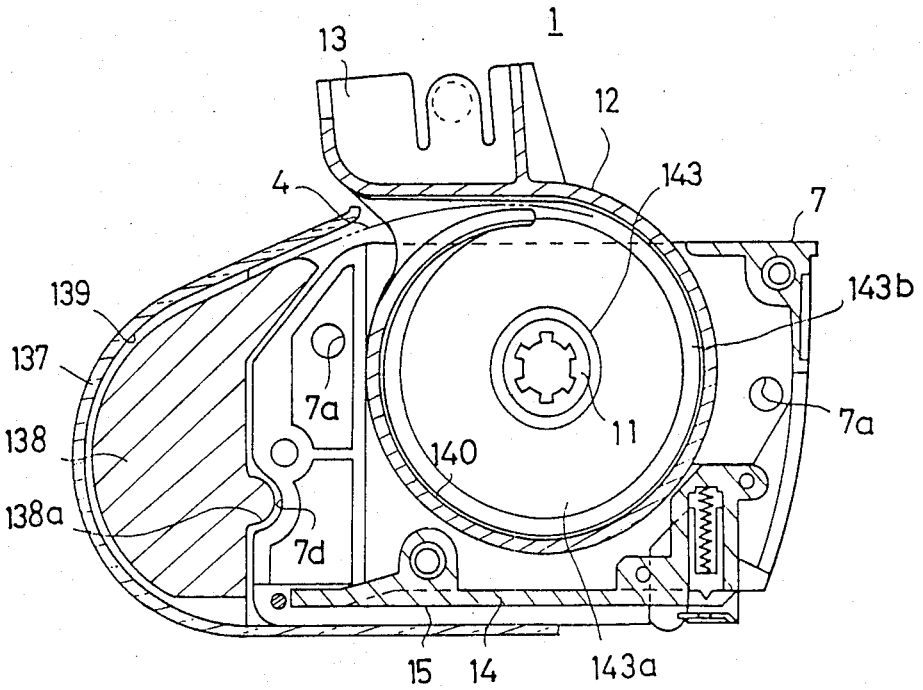
FIG. 30 is a longitudinally sectional side elevation for explaining construction of a third embodiment of the present invention.
Figure 31:
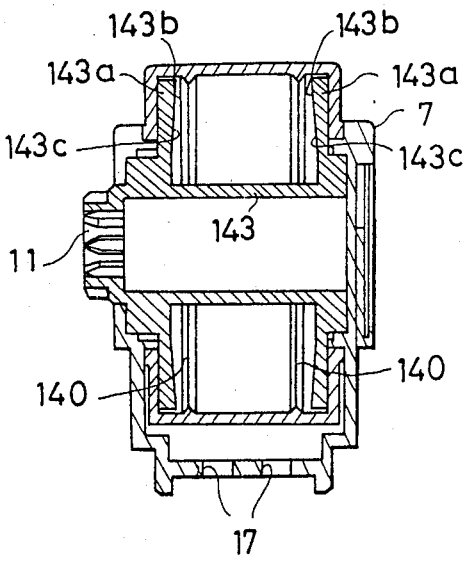
FIG. 31 is a longitudinally sectional front elevation showing the state in which the rotary member of FIG. 30 is closed.

In the embodiment of FIGS. 30 and 31, rotary member 12 has its circumferential wall formed as a single spiral. Take-up core 143 is disposed inside of rotary member 12 and is rotatable with respect to the cassette frame 7. Take-up core 143 includes right and left flanges **43*a* having straight portions 143*b* at the outer circumferential edges on the inner faces of the flanges 143*a* and spaced apart by a distance slightly less than the width of label web 4. Thus, flanges 143*a* define tapered space 143*c* that is expanded or counter-tapered gradually in the radially inward direction. Take-up core 143 is also formed with boss 11 that is to be fitted on rotary shaft 121 of the printer. Rotary member 12 is also formed on its inner circumference with the two parallel ridges 140 of triangular cross-section, as in the embodiment of FIGS. 26–29**.

When the leading end of label web 4 after moving through guide groove 139 is first introduced to the inside of rotary member 12 by its circumferential wall, label web 4 is engaged between straight portions **143*b* of flanges 143*a* on take-up core 143. The latter is turned by rotary shaft 108 of printer 3 so that label web 4 is instantly taken up. Gradually, label web 4 is pulled inwardly in a spiral form while contacting with the ridges 140 until being forced inward, finally losing contact with straight portions 143*b*. By providing straight portions 143*b*, label web 4 is positively taken up as it enters cassette 1 without the necessity of additional parts, such as guide spring 9 (FIG. 1**), so that winding resistance generated by the pressure of that spring is eliminated.

Fourth Embodiment

Figure 32:
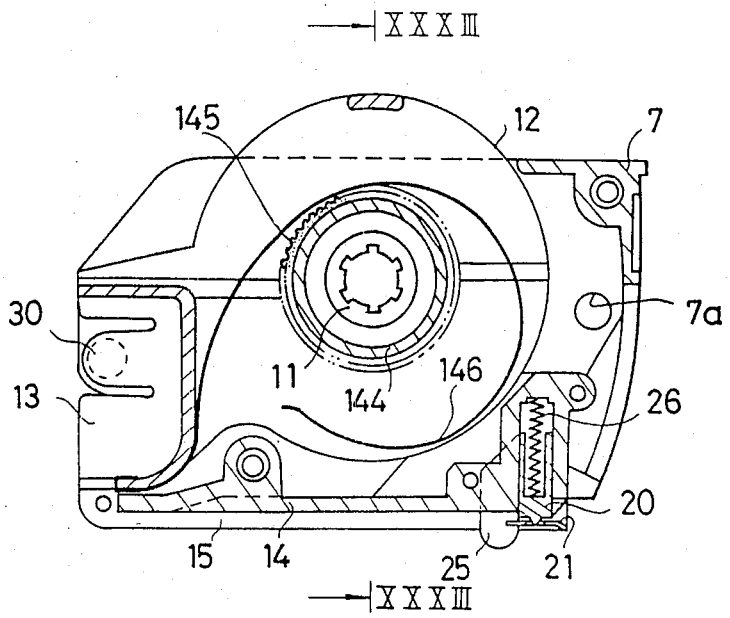
FIG. 32 is a longitudinally sectional side elevation for explaining a fourth embodiment of the present invention.
Figure 33:
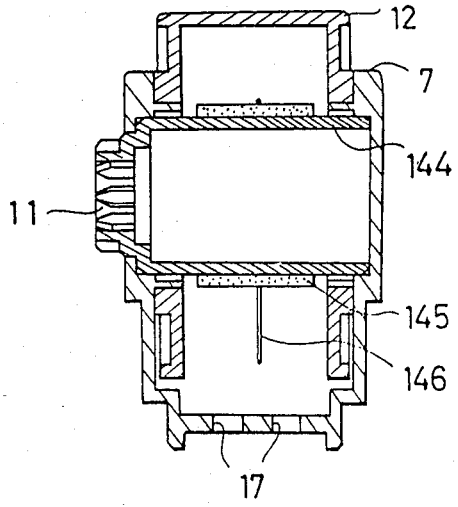
FIG. 33 is a section taken along line XXXIII—XXXIII of FIG. 32, looking in the direction of arrows XXXIII—XXXIII.

FIGS. 32 and 33 illustrate a fourth embodiment of the present invention in which take-up core 144 disposed within rotary member 12 is not formed with any side flanges, but its outer circumference is covered with friction member 145 made of rubber or the like. Guide member 146, constructed of steel wire or the like, is disposed within rotary member 12 and extends from the inner side of label holding portion 13 for about one turn. Guide member 146 has its leading end free and its intermediate portion biased into contact with friction member 145.

Thus, label web 4 is guided from the entrance of rotary member 12 along guide member 146 and is clamped between the latter and friction member 145 until label web 4 is automatically wound on take-up core 144. As label web 4 is being wound, the portion of guide member 146 contacting label web 4 shifts outward gradually.

Fifth Embodiment

Figure 34:
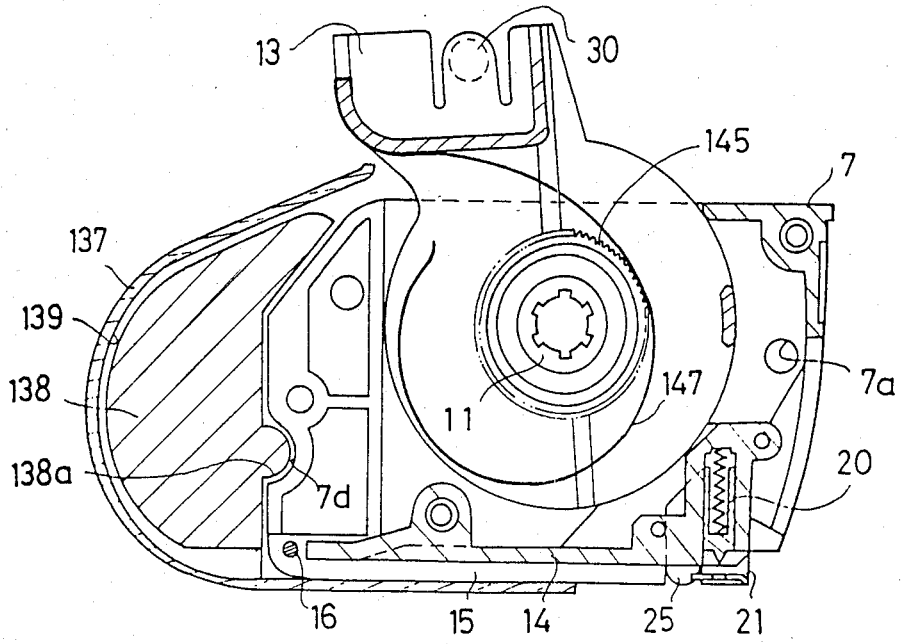
FIG. 34 is a longitudinally sectional side elevation for explaining construction of a fifth embodiment of the present invention.
Figure 35:
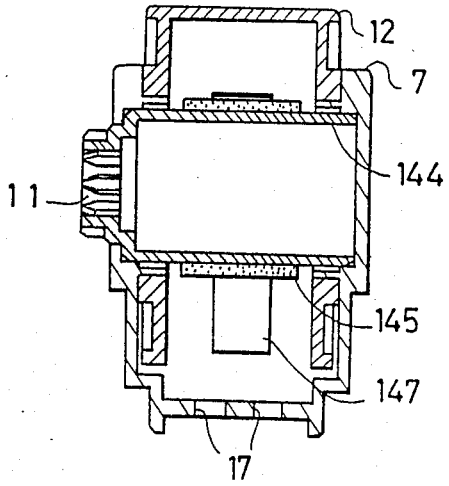
FIG. 35 is a longitudinally sectional front elevation showing the state in which the rotary member of FIG. 34 is closed.

FIGS. 34 and 35 show another embodiment of the present invention which differs from the embodiment of FIGS. 32 and 33 only in that leaf spring 147 is used as the guide member. Leaf spring 147 is relatively wide to obtain a relatively large contact area with label web 4 so that the latter is held by an increased frictional force.

Sixth Embodiment

Figure 36:
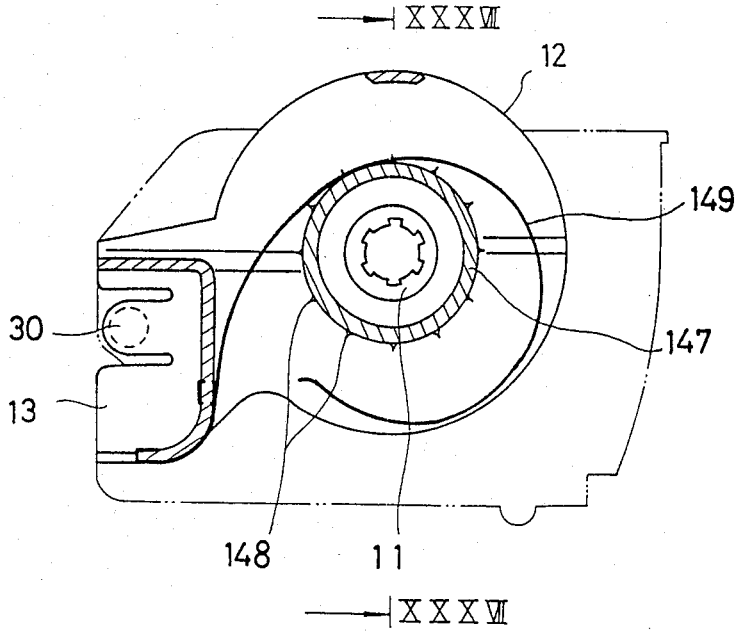
In FIGS. 36 to 38 showing a sixth embodiment of the present invention.
Figure 37:
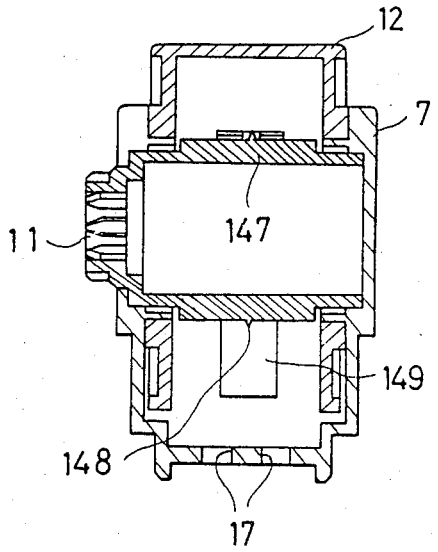
Figure 38:
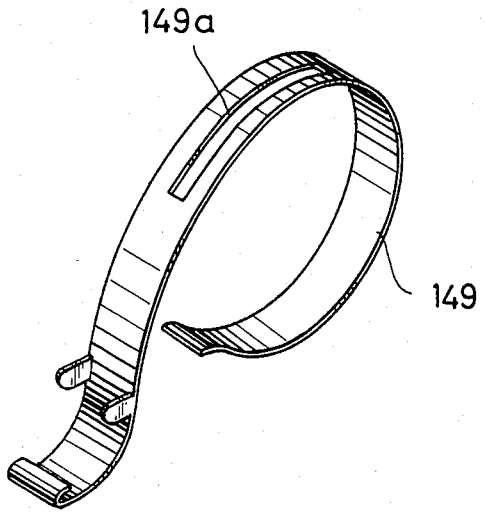
Figure 39:
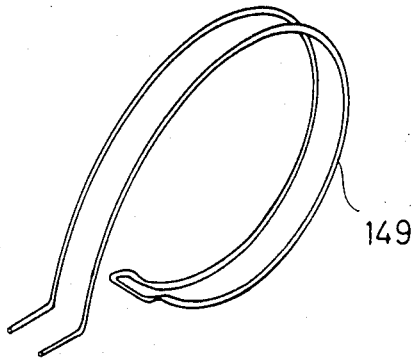
FIG. 39 is a perspective showing a modification of the guide member of FIG. 38.

FIGS. 36 through 38 show another embodiment of the present invention in which the outer circumference of takeup core 147 is provided with a plurality of needles 148 arranged to project from the central portion (widthwise) of core 147 and at a predetermined pitch in the circumferential direction. Also provided is guide member 149 which has one end fixed to label holding portion 13 of rotary member 12. Guide member 149 is curved about one turn within rotary member 12 while contacting the take-up core 147 at its central portion (widthwise). Guide member 149 (FIG. 38) is a leaf spring, and its contacting portion with take-up core 147 is formed with slit 149*a* of predetermined length to provide clearance for needles 148. In the alternative, guide member 149 may be constructed of two parallel guide elements which are formed by folding back a steel wire (FIG. 39).

With the construction of FIGS. 36–38, label web 4 is directed by guide member 149 to take-up core 147 and is trapped between guide member 149 and take-up core 147. Needles 148 bite into the backing paper 5 of label web 4 so that a positive pulling force is applied to label web 4. Guide member 149 moves away from the center of core 147 as the amount of label web 4 taken up increases.

Seventh Embodiment

Figure 40:
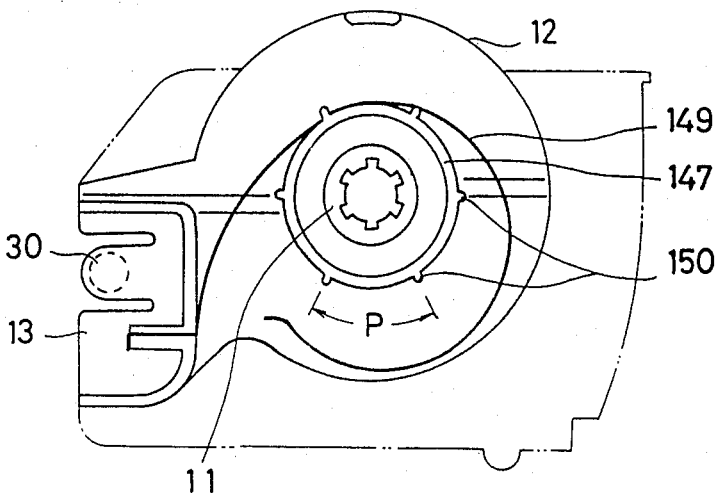
FIG. 40 is a longitudinally sectional side elevation showing a cassette constructed according to a seventh embodiment of the present invention.
Figure 41:
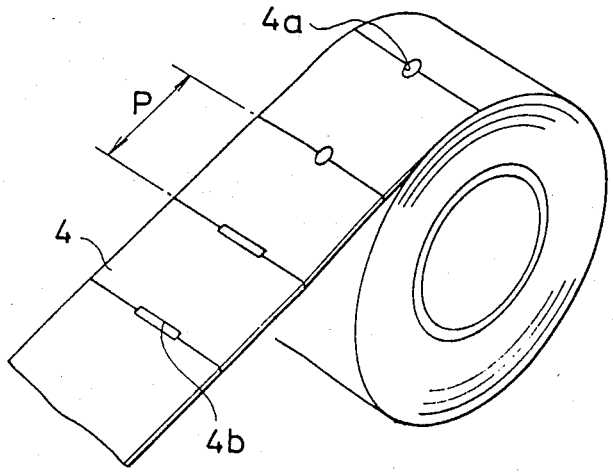
FIG. 41 is a perspective showing a label web which can be loaded to the cassette of FIG. 40.

FIGS. 40 and 41 show another embodiment of the present invention in which the outer circumference of take-up core 147 is provided with pins 150 in place of the needles of FIG. 36. Pins 150 have a predetermined pitch or circumferential spacing and guide member 149 is similar to those shown in FIGS. 38 and 39. The label web 4 used with the cassette of FIG. 40 is formed with holes 4*a* or slits 4*b* between the adjacent labels at a pitch P (FIG. 41) equal to the pitch of the pins 150.

Eighth Embodiment

Figure 42:
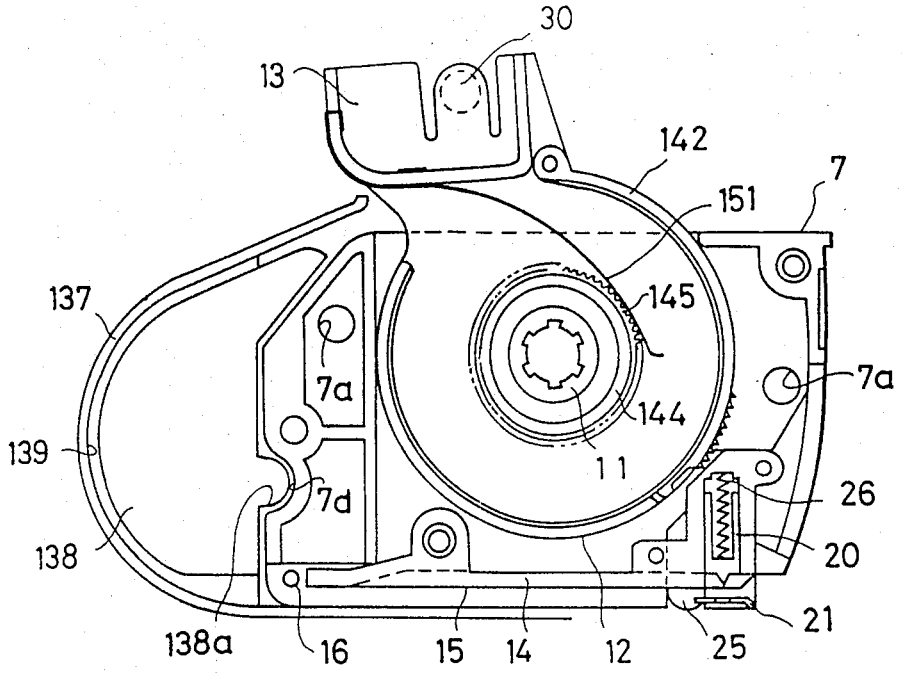
FIG. 42 is a longitudinally sectional side elevation showing a cassette according to an eighth embodiment of the present invention.
Figure 44:
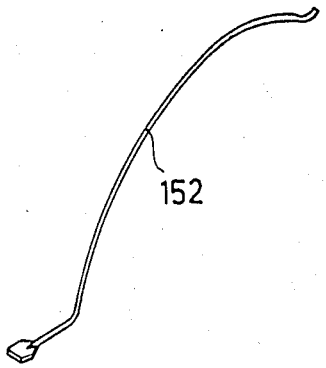
FIG. 44 is a perspective showing a modification of the guide member of FIG. 43.
Figure 43:
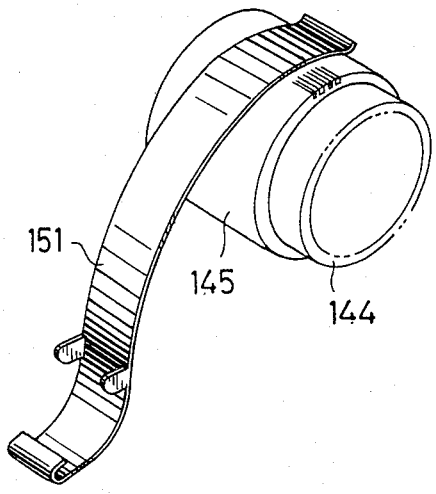
FIG. 43 is a perspective showing the take-up core and guide member of FIG. 42.
Figure 45:
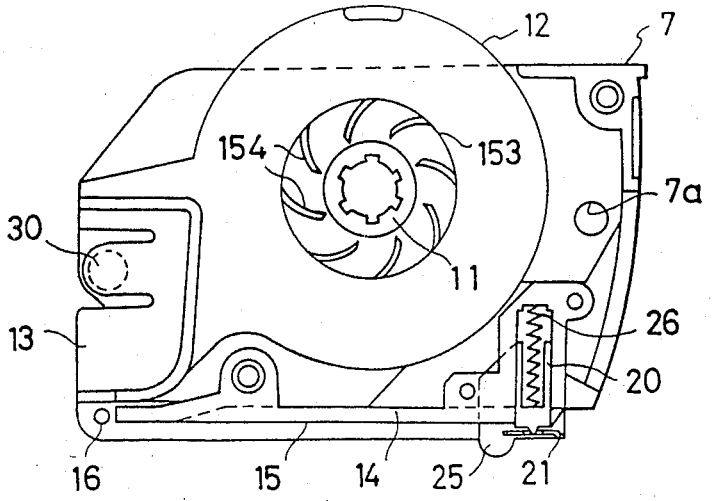
In FIGS. 45 to 48 showing a ninth embodiment of the present invention.

FIGS. 42 and 43 show another embodiment of the present invention in which rotary member 12 is provided with cover 142, as in FIG. 29, and the circumference of take-up core 144 is covered with a friction member, as in FIG. 32, and in which there is cantilever guide member 151. The latter, as shown in FIG. 43, is an arcuately curved leaf spring. One end of guide member 151 is fixed to label holding portion 13 of rotary member 12 and the other end is biased toward contact with friction member 145. Label web 4 directed by guide groove 139 is introduced into the gap between guide member 151 and friction member 145 so that web 4 can be taken up forcibly and automatically. Alternatively, guide member 151 may be replaced by steel wire 152, as shown in FIG. 44.

Ninth Embodiment

FIGS. 45 through 48 show still another embodiment of the present invention in which take-up core 153 is of a different construction than those of the foregoing embodiments and in which a portion 156 of the lead-in guide groove is automatically repositioned.

Figure 46:
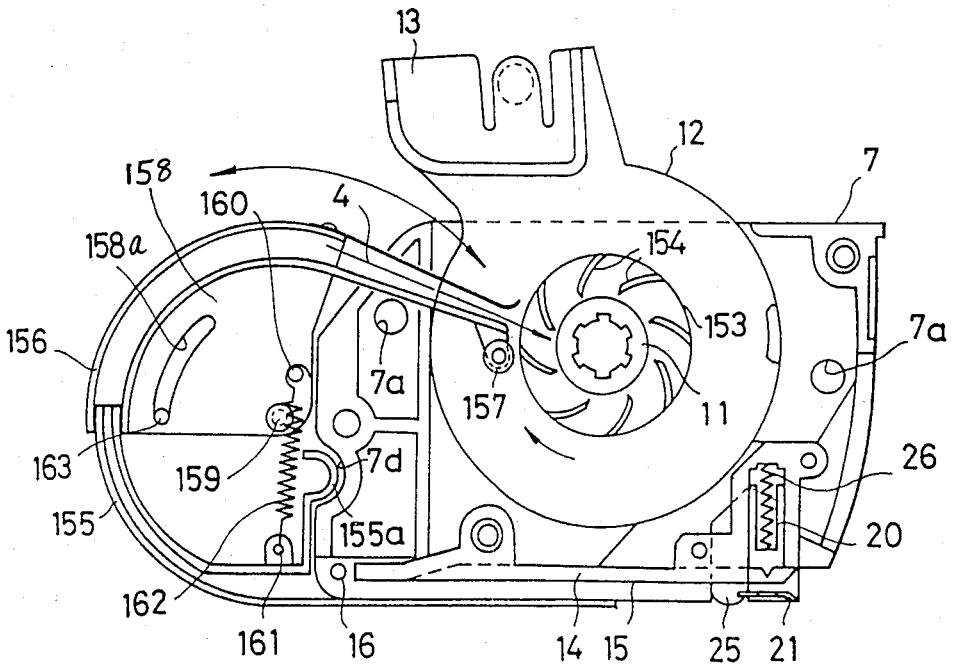

That is, take-up core 153 includes a plurality of radially arranged spirally curved vanes 154, and is rotated in the curved direction of the vanes 154, as indicated by arrow in FIG. 46.

Guide groove means is defined by both stationary guide member 155, which is made separate but extends from the label guide 124, and movable guide member 156. Stationary guide member 155 defines an arc of approximately one-quarter circle and is of C-shaped cross-section. Attached to guide member 155 at its downstream end is curved section 155*a* which is to be fitted in notches 7*d* at the leading end portion of cassette frame 7. Movable guide member 156 is an arcute gutter having a C-shaped cross-section so that it is slidably fitted on the outside of stationary guide member 155. Roller 157 is rotatably mounted to guide member 156 near the leading end portion thereof. Movable guide member 156 is fixed on a supporting sector 158 which has its pivot 159 rotatably mounted on base frame 90 or on the bracket 136. Tensioned coil spring 162 is mounted between pin 160, which is anchored in the vicinity of pin 159 for sector 158, and a pin 161 which is anchored at the stationary guide member 155.

With the construction thus far described, at the start of the winding operation, as shown in FIG. 46, movable guide member 156 is turned clockwise on the pin 159, as viewed in FIG. 46 until pin 163 bottoms in slot 158*a* in sector 158, so that guide roller 157 is brought adjacent the circumference of take-up core 153. In this state, supporting sector 158 is biased clockwise since spring 162 is positioned overcenter to the right of pin 159 as viewed in FIG. 46. As a result, guide roller 157 is held adjacent the circumference of the take-up core 13, so that as label web 4, having been guided by guide members 155 and 156, advances into the gap between vanes 154 of take-up core 153, the lead end of web 4 is folded in the form of a letter "V" by vanes 154 as take-up core 153 rotates. As a result, label web 4 is forcibly wound on take-up core 153 by the frictional force which is established between its folded portion and vane 154.

Figure 47:
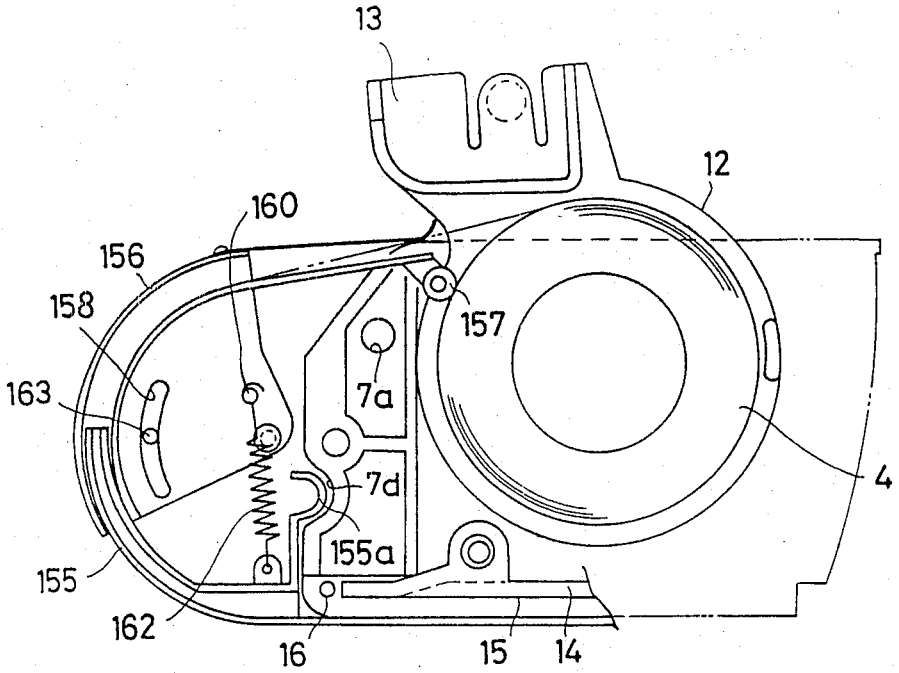
Figure 48:
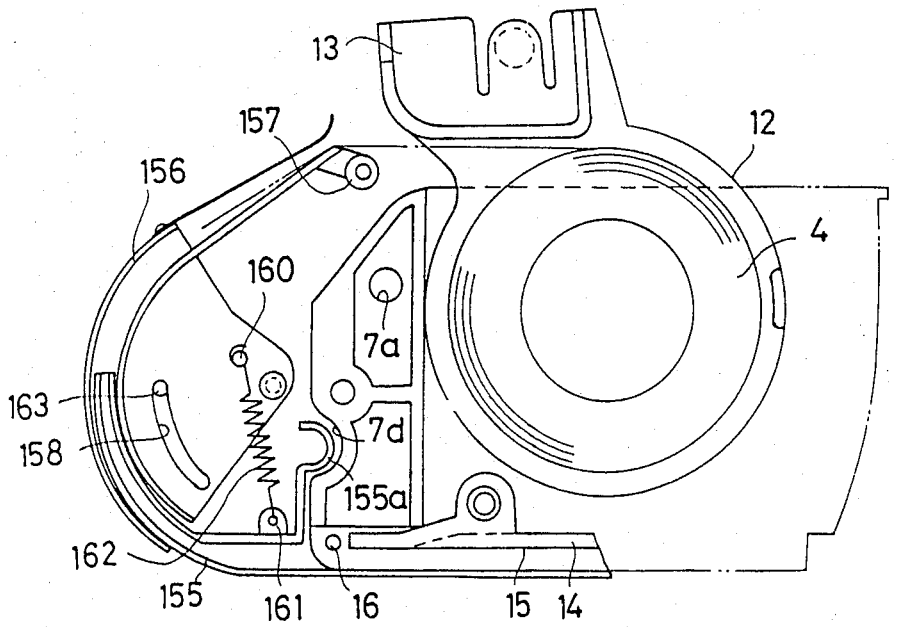

As the label web 4 winds on core 153, engagement between roller 157 and web 4 forces movable guide member 156 and supporting sector 158 to pivot counterclockwise with respect to FIG. 46. As shown in FIGS. 47 and 48, when spring 162 passes over pin 159, movable guide member 156 is abruptly turned counterclockwise by the tension of the spring 162. The turning limits of supporting sector 158 are regulated by the cooperation of arcuate guide groove 158*a* in supporting sector 18 and stationary guide pin 163 that extends through guide groove 158*a*.

By utilizing the constructions described herein, label web 4 can be taken up automatically, and when label web 4 is taken up in a predetermined amount, this can be detected by means of a limit switch (not shown) so that the winding operation can be promptly interrupted. Although not shown, the motor for driving take-up core 13 may be controlled so that it does not operate until the leading end of label web 4 is detected by means of an optical sensor (not shown) which is disposed at the center of take-up core 153.

It should now be apparent to those skilled in the art that merely by mounting the cassette in the printer, the label web having its labels printed with bar codes can be automatically wound while automating the setting of the backing paper in the bottom of the cassette. Thus, it is possible to completely automate the label winding and mounting operation which has bottlenecked the development of portable label applying systems. Moreover, the cassette mounting and dismounting mechanism can be operated by the single action of operating the actuating lever so that the mounting and dismounting operations are simplified greatly and related problems are eliminated. By utilizing the peel preventing member, labels are not peeled, but can be taken up completely automatically when the label web is to be wound automatically.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A portable label applying system including:

a printer for printing indicia on a plurality of labels adhered in a longitudinal series to a web of backing paper to form a printed label web;

a cassette for receiving a printed label web printed by said printer, said cassette being adapted for mounting to a label applicator for dispensing printed labels from said cassette and applying them to commodities; and an automatic label winding and charging means comprising:

cassette mounting means disposed in said printer for operatively mounting said cassette in said printer to receive a printed label web, guide means disposed adjacent to said cassette mounting means for directing a printed label web into said cassette, winding means disposed in said cassette for winding a printing label web being fed from said printer, and peel preventing means for cooperating with said guide means for preventing labels from being peeled from a printed label web being received by said cassette, said guide means comprising a curved guide member having an inwardly curved side for guiding said printed label web, said peel preventing means comprising a peel preventing member having a curved side facing said inwardly curved side and profiled to define an arcuate guide groove between said curved guide member and said peel preventing member.

2. A portable label applying system including:

a printer for printing indicia on a plurality of labels adhered in a longitudinal series to a web of backing paper to form a printed label web;

a cassette for receiving a printed label web printed by said printer, said cassette being adapted for mounting to a label applicator for dispensing printed labels from said cassette and applying them to commodities; and an automatic label winding and charging means comprising:

cassette mounting means disposed in said printer for operatively mounting said cassette in said printer to receive a printed label web, guide means disposed adjacent to said cassette mounting means for directing a printed label web into said cassette, and winding means disposed in said cassette for winding a printing label web being fed from said printer, the winding means including a rotary member having an inner circumference for guiding thereon a printed label web being received by said cassette.

3. A portable label applying system as set forth in claim 2 in which the rotary member is formed with a plurality of circumferential ridges on its inner circumference.

4. A portable label applying system as set forth in claim 2 in which the winding means also includes a transparent cover hinged to said rotary member for covering an opening that communicates with the inside of said rotary member.

5. A portable label applying system as set forth in claim 2 in which the winding means also includes a take-up core on which a printed label web in said cassette is wound, said core being mounted for rotation relative to said rotary member.

6. A portable label applying system as set forth in claim 5 in which the take-up core includes first and second spaced flanges and a straight core body extending therebetween, said flanges defining a winding space having a section that is counter-tapered radially outwardly of said take-up core with at least a portion of said winding space section being slightly narrower than a printed label web being received by said cassette.

7. A portable label applying system as set forth in claim 5 in which the take-up core includes first and second spaced flanges having inner faces with straight portions forming the outer circumferential edges thereof and spaced at a distance to define a space that is slightly narrower than a printed label web being received by said cassette, said space being counter-tapered radially inwardly of said take-up core.

8. A portable label applying system as set forth in claim 5 in which the printer includes a rotary shaft and the take-up core has a boss adapted to be turned by said rotary shaft.

9. A portable label applying system as set forth in claim 5 in which the take-up core includes an outer circumference and a friction member mounted on said outer circumference.

10. A portable lael applying system as set forth in claim 5 in which the take-up core includes an outer circumference and a plurality of projections formed on said outer circumference, said projections being arranged at a predetermined pitch in the circumferential direction.

11. A portable label applying system as set forth in claim 10 in which the projections are needles.

12. A portable label applying system as set forth in claim 10 in which the projections are pins.

13. A portable label applying system as set forth in claim 5 in which the take-up core includes a plurality of vanes arranged at a predetermined spacing to form radially arranged spiral curves for folding the leading end of an incoming printed label web to forcibly wind the same on said core.

14. A portable label applying system as set forth in claim 5 in which the winding means also includes a guide member having one end thereof fixed to said rotary member and another portion biased toward contact with said take-up core at a portion of the outer circumference thereof for forcing an incoming printed label web onto said outer circumference.

15. A portable label applying system as set forth in claim 14 in which the guide member is constructed of leaf spring material.

16. A portable label applying system as set forth in claim 15 in which the guide member has a longitudinal slit.

17. A portable label applying system as set forth in claim 14 in which the guide member is constructed of steel wire material.

18. A portable label applying system as set forth in claim 17 in which the steel wire material is folded to form a plurality of parallel guide wires.

19. A portable label applying system as set forth in claim 2 in which:

said cassette includes a frame;

said rotary member being mounted for movement between first and second positions relative to said frame, said rotary memer being in said first position while a printed label web is being received by said cassette and being in said second position when labels are being withdrawn from said cassette;

said cassette mounting means also including a section on said printer cooperatively engageable with a section on said rotary member when the latter is in said first position to permit mounting of said cassette in said printer, said section on said printer interfering with mounting of said cassette in said printer when said rotary member is not in said first position.

20. A portable label applying system as set forth in claim 19 in which said rotary member is pivoted relative to the frame in moving between said first and second positions.

21. A portable label applying system as set forth in claim 3 in which said cassette includes locating formations that cooperate with locating formations of said mounting means for operatively positioning said cassette relative to said printer to receive a printed label web from the latter.

22. A portable label applying system as set forth in claim 21 in which said mounting means also includes a manually operable means to releasably maintain said cassette operatively positioned in said printer to receive a printed label web from the latter.

23. A portable label applying system as set forth in claim 22 in which said manually operable means includes a plurality of levers and link means operatively connecting said levers for operation thereof from a single location.

24. A portable label applying system including:

a printer for printing indicia on a plurality of labels adhered in a longitudinal series to a web of backing paper to form a printed label web;

a cassette for receiving a printed label web printed by said printer, said cassette being adapted for mounting to a label applicator for dispensing printed labels from said cassette and applying them to commodities; and an automatic label winding and charging means comprising:

cassette mounting means disposed in said printer for operatively mounting said cassette in said printer to receive a printed label web, guide means disposed adjacent to said cassette mounting means for directing a printed label web into said cassette, and winding means disposed in said cassette for winding a printing label web being fed from said printer, said winding means including a rotatable core;

said guide means including a guide section having an exit at one end thereof, said guide section being movable between a first and a second position relative to a cassette operatively mounted in said printer;

with said guide section in said first position, said exit being inside of said cassette to direct a printed label web toward the rotational axis of said core; with said guide section in said second position, said exit being outside of said cassette to permit the latter to be mounted in and dismounted from the printer;

said automatic label winding and charging means further comprising means for moving said exit away from said first position toward said second position automatically as an increasing length of a printed label web winds on said core.

25. A portable label applying system as set forth in claim 24 in which means for moving said exit includes a follower on said guide section to gauge the quantity of printed label web wound on said core.

26. A portable label applying system as set forth in claim 25 in which said guide section is operatively mounted on a pivot, overcenter spring means for biasing said guide section toward said first position when said spring means has its line of action to one side of said pivot and toward said second position when said line of action is to the other side of said pivot.

27. A portable label applying system as set forth in claim 26 in which there is a pin-slot means to limit movement of the guide section between the first and second positions.

28. A portable label applying system as set forth in claim 25 in which said follower includes a roller that rides on a printed label web as it is being wound on the core.

* * * * *